US007311384B2

(12) United States Patent
Nakazawa et al.

(10) Patent No.: US 7,311,384 B2
(45) Date of Patent: Dec. 25, 2007

(54) INK JET HEAD, CONTROL METHOD THEREFOR, AND INK JET RECORDING APPARATUS

(75) Inventors: Yusuke Nakazawa, Shizuoka (JP); Koji Furukawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 295 days.

(21) Appl. No.: 11/225,054

(22) Filed: Sep. 14, 2005

(65) Prior Publication Data

US 2006/0055716 A1 Mar. 16, 2006

(30) Foreign Application Priority Data

Sep. 14, 2004 (JP) ..... 2004-266974
Sep. 14, 2004 (JP) ..... 2004-266975

(51) Int. Cl.
*B41J 2/06* (2006.01)

(52) U.S. Cl. ..... 347/55; 347/54; 347/56

(58) Field of Classification Search ..... 347/55, 347/54, 56, 5, 9–12
See application file for complete search history.

(56) References Cited

U.S. PATENT DOCUMENTS 6,158,844 A * 12/2000 Murakami et al. ..... 347/55
6,286,938 B1 * 9/2001 Okano et al. ..... 347/55
6,908,177 B2 * 6/2005 Suganuma ..... 347/55

FOREIGN PATENT DOCUMENTS

| | | |
|---|---|---|
| EP | 0 899 106 A2 | 3/1999 |
| JP | 2000-25233 A | 1/2000 |
| WO | WO 02/057086 A1 | 7/2002 |

OTHER PUBLICATIONS

Japanese Abstract No. 2001030498, dated Feb. 6, 2001.
Japanese Abstract No. 2000127408, dated May 9, 2000.

* cited by examiner

*Primary Examiner*—Lam Son Nguyen
(74) *Attorney, Agent, or Firm*—Sughrue Mion Pllc.

(57) ABSTRACT

The present invention provides a control method for controlling an ink jet head. The inkjet head includes an ejection port substrate having ejection ports for ejection of the droplets, ejection electrodes respectively being located in a position corresponding to each of the ejection ports, and a guard electrode formed in the ejection port substrate. The control method includes the steps of: applying a drive voltage to each of the ejection electrodes in accordance with a drawing signal; and applying an AC bias voltage to the guard electrode, the AC bias voltage having the same frequency as the drive voltage applied to each of the ejection electrodes and alternately repeating a first voltage and a second voltage being lower than the first voltage.

16 Claims, 7 Drawing Sheets

INK JET HEAD, CONTROL METHOD THEREFOR, AND INK JET RECORDING APPARATUS

The entire contents of literatures cited in this specification are incorporated herein by reference.

BACKGROUND OF THE INVENTION

The present invention relates to an ink jet head, a control method for the ink jet head, and an ink jet recording apparatus with which an image is formed on a recording medium by ejecting ink toward the recording medium. More specifically, the present invention relates to an ink jet head, a control method for the ink jet head, and an ink jet recording apparatus with which ink containing charged fine particles are ejected through the ink jet head by utilizing electrostatic forces.

An electrostatic ink jet recording system is known in which ink is ejected toward a recording medium by utilizing electrostatic forces. In the electrostatic ink jet recording system, ink containing a charged fine particle component is used and ink droplets are ejected from ejection ports for ejection of the ink toward a recording medium by exerting electrostatic forces on the ink at the ejection ports through application of drive voltages to ejection electrodes arranged on the periphery of the ejection ports. By controlling the drive voltages applied to the ejection electrodes in accordance with image data, it is possible to record an image corresponding to the image data on the recording medium.

As an ink jet head used in a recording apparatus adopting the electrostatic ink jet recording system, a multi-channel head is known in which multiple ejection ports (channels) are arranged in one head. In order to perform recording at higher resolution using the multi-channel electrostatic ink jet head, it is required to dispose ejection portions at a high density and to control ejection ports independently of one another. With the electrostatic ink jet head as described above, however, ink droplets are ejected by utilizing electrostatic forces generated through application of voltages to ejection electrodes at the respective ejection ports. Therefore, when the ejection ports are disposed at a high density, electric field interference occurs between adjacent ejection ports and variations occur to the size of ejected ink droplets and to the flying direction of the ink droplets, which leads to a problem in that it is impossible to perform precise recording.

In view of such a problem, JP 2000-25233 A discloses an ink jet recording apparatus in which multiple ejection electrodes (individual electrodes) are provided on a substrate dividing ink guides and ink droplets are ejected from the ink guides by means of electrostatic forces generated through application of voltages to the ejection electrodes, where a shield electrode for shielding electric lines of force from adjacent channels is formed between the ejection electrodes. In this ink jet recording apparatus, a voltage, which is lower than the voltages applied to the ejection electrodes but is sufficiently high enough not to be discharged between the ejection electrodes, is applied to the shield electrode, thereby suppressing interference between adjacent ejection electrodes.

In the ink jet recording apparatus disclosed in JP 2000-25233 A, however, the ejection electrodes and the shield electrode are provided on the same surface, so it is impossible to shield electric lines of force generated from end portions on an outer peripheral side of the ejection electrodes with the shield electrode, which leads to a problem in that it is impossible to effectively prevent electric field interference between adjacent ejection ports.

In order to suppress the electric field interference, it is effective to provide a wide shield electrode between adjacent ejection ports. As in the case disclosed in JP 2000-25233 A in which the shield electrode and the ejection electrodes are provided on the same surface, however, when ejection ports are disposed at a high density, it is impossible to secure a sufficient width of the shield electrode between the adjacent ejection ports. On the other hand, when the intervals between the ejection portions are increased in order to increase the width of the shield electrode between the ejection ports, this results in an unfavorable situation in which the density of the ejection ports is lowered and a head size is increased. Therefore, there arises a problem in that it is difficult to perform precise recording with a compact head.

In order to draw a high-quality image at high speed on recording medium using an electrostatic ink jet head, it is required to supply a sufficient amount of charged colorant particles to ejection portions swiftly. As a method of supplying the colorant particles to the ejection portions swiftly, for instance, a method utilizing a liquid current and a method with which the colorant particles are caused to move to ejection ports by electrophoresis are conceivable.

These methods, however, are not enough to completely preclude a danger that an inconvenient situation will occur in which, for instance, a sufficient amount of colorant particles is not supplied to ejection portions swiftly, clogging of ejection ports of an ink jet head occurs, or dots formed on a recording medium are split.

SUMMARY OF THE INVENTION

The present invention has been made in the light of the circumstances described above and a first object of the present invention is to provide: an ink jet head; a control method for the ink jet head; and an ink jet recording apparatus, with which at the time of ejection of ink droplets, it becomes possible to perform drawing at high speed with stability by supplying colorant particles to ejection ports swiftly and with reliability and at the time of non-ejection of ink droplets, it becomes possible to achieve stability even with respect to vibration or the like by preventing unnecessary spills of ink while maintaining concentratability of the ink at the ejection ports.

A second object of the present invention is to provide an ink jet head, an ink jet recording apparatus provided with the ink jet head, and a control method for the ink jet head, with which it becomes possible to prevent delay of ejection of ink droplets and improve the ink ejection property with which a desired amount of an ink droplet is completely ejected before the completion of an ejection operation.

A third object of the present invention is to provide an ink jet head, an ink jet recording apparatus provided with the ink jet head, and a control method for the ink jet head, with which it becomes possible to reduce drive voltages applied to ejection electrodes and achieve a cost reduction through simplification of the construction of a drive circuit.

The inventor of the present invention has found that, in an ink jet head having a guard electrode and ejection electrodes provided in an ejection port substrate in which ejection ports are formed, when a DC bias voltage of 300 [V], for example, is applied to the guard electrode and a voltage of 600/0 [V], for example, is applied to each of the ejection electrodes in accordance with on/off of a drawing signal, colorant particles (fine particles containing colorant, such as pigment, and having electrical charges) receive electrostatic forces due to electric fields formed by the ejection electrodes and the guard electrode, to thereby provide the following effects.

At the time of a stop of the ink jet head, that is, when the ink is not ejected, the drive voltage Vp (0 [V]) applied to each of the ejection electrodes becomes lower than the DC bias voltage Vg (300 [V]) applied to the guard voltage. Therefore, for the ejection ports, electric fields based on a voltage difference between the voltages applied to the ejection electrodes and the voltage applied to the guard electrode are formed. Due to the electric fields, electrostatic force in a direction opposite to the ejection direction of the ink is exerted on a meniscus of the ink formed at each of the ejection ports, and the meniscus is pressed inwardly. As a result, spills of the ink from the ejection ports and unnecessary ejection of ink droplets are suppressed.

On the other hand, at the time of ejection of the ink, the drive voltage Vp (600 [V]) applied to each of the ejection electrodes becomes higher than the DC bias voltage Vg (300 [V]) applied to the guard electrode. Then, based on a voltage difference between the voltage applied to each of the ejection electrodes and the voltage applied to the guard electrode, electric fields are formed for the ejection ports. Due to the electric fields, electrostatic forces in the ejection direction of the ink are exerted on the meniscuses of the ink formed at the ejection ports and the meniscuses are released from the pressed state. As a result, a state is obtained in which the ink is easy to eject.

In order to attain the objects described above, according to a first aspect of the present invention, there is provided a control method for controlling an ink jet head that ejects droplets of ink by means of electrostatic forces, the ink jet head including an ejection port substrate having ejection ports for ejection of the droplets, ejection electrodes respectively being located in a position corresponding to each of the ejection ports and respectively generating electrostatic fields for each of the ejection ports, and a guard electrode formed in the election port substrate under an insulated state from the ejection electrodes at positions on an ink ejection side with respect to the ejection electrodes between adjacent ejection ports in order to shield against electric fields generated from adjacent ejection electrodes and commonly controlled, the control method including the steps of: applying a drive voltage to each of the ejection electrodes in accordance with a drawing signal; and applying an AC bias voltage to the guard electrode, the AC bias voltage having the same frequency as the drive voltage applied to each of the ejection electrodes and alternately repeating a first voltage and a second voltage being lower than the first voltage.

In the ink jet head control method according to the first aspect of the present invention, it is preferable that the first voltage be a positive voltage and the second voltage is a negative voltage.

In addition, it is preferable that the AC bias voltage be applied such that a phase thereof is opposite to a phase of a signal of the drive voltage at the time of formation of one dot on a recording medium.

Further, it is preferable that the AC bias voltage be applied such that at least one of phase and pulse width thereof differs from those of the signal of the drive voltage at the time of the formation of one dot on the recording medium. In this case, it is preferable that at least one of the phase and pulse width of the AC bias voltage be controlled such that the AC bias voltage changes to the second voltage immediately before the drive voltage is applied to each of the ejection electrodes and it is preferable that at least one of the phase and pulse width of the AC bias voltage be controlled such that the AC bias voltage changes to the first voltage before the completion of application of the drive voltage to each of the ejection electrodes.

In the first aspect of the present invention, it is preferable that the ink be obtained by dispersing charged fine particles containing at least colorant in an insulative dispersion medium.

In order to attain the objects described above, according to a second aspect of the present invention, there is provided an ink jet head for recording an image on a recording medium by ejecting droplets of ink including charged fine particles by means of electrostatic forces, the ink jet head including: an ejection port substrate having ejection ports for ejection of the droplets; ejection electrodes respectively being located in a position corresponding to each of the ejection ports and respectively generating electrostatic fields for each of the ejection ports; a guard electrode formed in the ejection port substrate under an insulated state from the ejection electrodes at positions on an ink ejection side with respect to the ejection electrodes between adjacent ejection ports in order to shield against electric fields generated from adjacent ejection electrodes; and a guard electrode control portion connected to the guard electrode for controlling an AC bias voltage to apply the AC bias voltage to the guard electrode, the AC bias voltage having the same frequency as the drive voltage applied to each of the ejection electrodes and alternately repeating a first voltage and a second voltage being lower than the first voltage.

In the ink jet head according to the second aspect of the present invention, it is preferable that the first voltage be a positive voltage and the second voltage is a negative voltage.

In addition, in the ink jet head according to the second aspect of the present invention, it is preferable that the guard electrode control portion apply the AC bias voltage such that phase of the pulse voltage becomes opposite to that of a signal of the drive voltage applied to each of the ejection electrodes at the time of formation of one dot on the recording medium, Further, in the ink jet head according to the second aspect of the present invention, it is preferable that the guard electrode control portion apply the AC bias voltage such that at least one of the phase and pulse width thereof differs from those of the signal of the drive voltage applied to each of the ejection electrodes at the time of the formation of one dot on the recording medium. In this case, it is preferable that the guard electrode control portion control at least one of the phase and pulse width of the AC bias voltage such that the AC bias voltage changes to the second voltage immediately before the drive voltage is applied to each of the ejection electrodes and it is preferable that at least one of the phase and pulse width of the AC bias voltage be controlled so that the AC bias voltage changes to the first voltage before the application of the drive voltage to each of the ejection electrodes is ended.

In the ink jet heads according to the second aspect of the present invention, it is preferable that the ink be obtained by dispersing charged fine particles containing at least colorant in an insulative dispersion medium.

A third aspect of the present invention provides an ink jet recording apparatus, including: an ink jet head for recording an image on a recording medium by ejecting droplets of ink including charged fine particles by means of electrostatic forces; and moving means for relatively moving the ink jet head and the recording medium, wherein the ink jet head includes an ejection port substrate having ejection ports for ejection of the droplets; ejection electrodes respectively being located in a position corresponding to each of the ejection ports and respectively generating electrostatic fields for each of the ejection ports; a guard electrode formed in the ejection port substrate under an insulated state from the ejection electrodes at positions on an ink ejection side with respect to the ejection electrodes between adjacent ejection ports in order to shield against electric fields generated from adjacent ejection electrodes; and a guard electrode control portion connected to the guard electrode for controlling an AC bias voltage to apply the AC bias voltage to the guard electrode, the AC bias voltage having the same frequency as the drive voltage applied to each of the ejection electrodes and alternately repeating a first voltage and a second voltage being lower than the first voltage.

In the ink jet recording apparatus according to the present invention, it is preferable that the first voltage is a positive voltage and the second voltage is a negative voltage.

With the ink jet head control method according to the first aspect of the present invention, the AC bias voltage having the same frequency as the drive voltages applied to the ejection electrodes is controlled to be applied to the guard electrode so that the ink is easy to eject, at the time of ejection of the ink, and the ink is hard to eject at the time of non-ejection of the ink. Therefore, it becomes possible to prevent delay of the ejection of the ink and improve the ink ejection property. The ink ejection property as used here refers to a property with which a desired amount of an ink droplet is completely ejected before the completion of the ink ejecting operation. Also, it is possible to adjust the ink ejection delay and the ink ejection property independently of each other by controlling the AC bias voltage, so it becomes possible to improve image quality. Further, it becomes possible to control the ejection and non-ejection of the ink with reliability even when the voltage value of the drive voltages applied to the ejection electrodes is reduced from that in a conventional case.

Moreover, when the first voltage is set to a positive voltage and the second voltage is set to a negative voltage, the positive voltage and the negative voltage are alternately applied to the ejection electrodes, so it becomes possible to concentrate the ink by causing the colorant particles in the ink to aggregate near the surface of the ink at each of the ejection ports by means of electric fields generated between the guard electrode and the ejection electrodes when the drive voltages are applied to the ejection electrodes. Also, when the drive voltages are not applied to the ejection electrodes, the ink meniscuses at the ejection ports are pressed by electric fields generated between the guard electrode and the ejection electrodes in a direction opposite to the electric fields described above and the ink is made hard to eject, which makes it possible to prevent unnecessary spills of the ink from the ejection ports while maintaining the concentratability of the ink at the ejection ports.

Further, with the ink jet head according to the second aspect of the present invention and the ink jet recording apparatus according to the third aspect of the present invention, it becomes possible to apply the AC bias voltage having the same frequency as the drive voltages applied to the ejection electrodes to the guard electrode while being controlled at the guard electrode control portion, so it becomes possible to make adjustment so that the ink is easy to eject at the time of ejection of the ink, and the ink is hard to eject at the time of non-ejection of the ink. As a result, it becomes possible to prevent delay of ink ejection and also improve the ink ejection property. In addition, it becomes possible to reduce the voltage value of the drive voltages applied to the ejection electrodes from that in a conventional case merely by providing the guard electrode control portion that controls the AC bias voltage applied to the guard electrode, which makes it possible to significantly reduce the cost of a drive circuit.

Further, when the AC bias voltages (a pulse voltage), which has the same frequency as the drive voltages applied to the ejection electrodes and alternately repeats the positive voltage and the negative voltage, is applied to the guard electrode with the guard electrode control portion, it becomes possible to concentrate the ink by causing the colorant particles in the ink to aggregate near the surface of the ink at each of the ejection ports by means of electric fields generated between the guard electrode and the ejection electrodes while the drive voltages are applied to the ejection electrodes. Also, while the drive voltages are not applied to the ejection electrodes, the ink meniscuses at the ejection ports are pressed by electric fields generated between the guard electrode and the ejection electrodes in a direction opposite to the electric fields described above and the ink is made hard to eject, which makes it possible to prevent unnecessary spills of the ink from the ejection ports while maintaining the concentratability of the ink at the ejection ports. As a result, an ink jet recording apparatus are provided, which have high drawing stability and are capable of performing stabilized high-speed drawing even when vibration and the like occur.

DETAILED DESCRIPTION OF THE PREFERRED EMBODIMENTS

Hereinafter, the ink jet head, the control method for the ink jet head, and the ink jet recording apparatus according to the present invention will be described in detail based on preferred embodiments illustrated in the accompanying drawings.

Figure 1A:
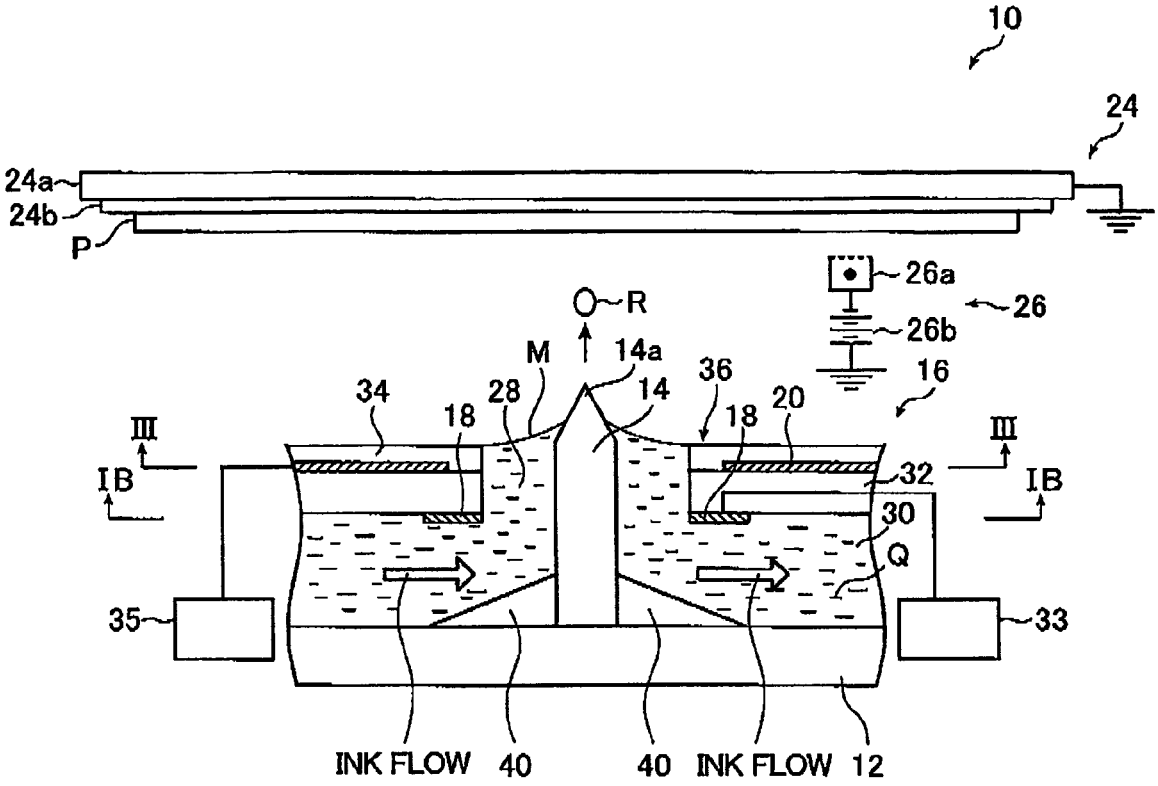
FIG. 1A is a cross-sectional view schematically showing an ink jet head according to the present invention.
Figure 1B:
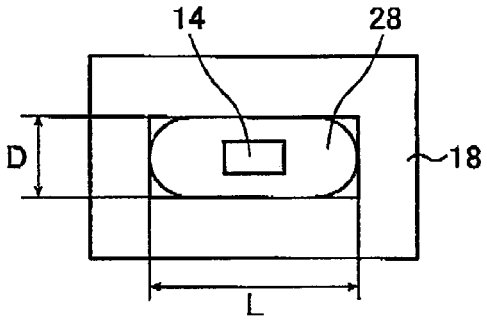
FIG. 1B schematically shows a planar construction of an ejection electrode.

FIG. 1A schematically shows a cross section of an outlined construction of the ink jet head according to the present invention and FIG. 1B is a cross-sectional view taken along line IB-IB in FIG. 1A. As shown in FIG. 1A, an ink jet head 10 includes a head substrate 12, ink guides 14, and an ejection port substrate 16 in which ejection ports 28 are formed. For the ejection port substrate 16, an ejection electrode 18 is disposed so that it surrounds the ejection port 28. At positions facing a surface on an ink ejection side (upper surface in FIG. 1A) of the ink jet head 10, a counter electrode 24 supporting a recording medium P and a charge unit 26 for charging the recording medium P are disposed.

Also, the head substrate 12 and the ejection port substrate 16 are disposed so that they face each other with a predetermined distance therebetween. By a space formed between the head substrate 12 and the ejection port substrate 16, an ink flow path 30 for supplying ink to each ejection port 28 is formed.

Figure 2:
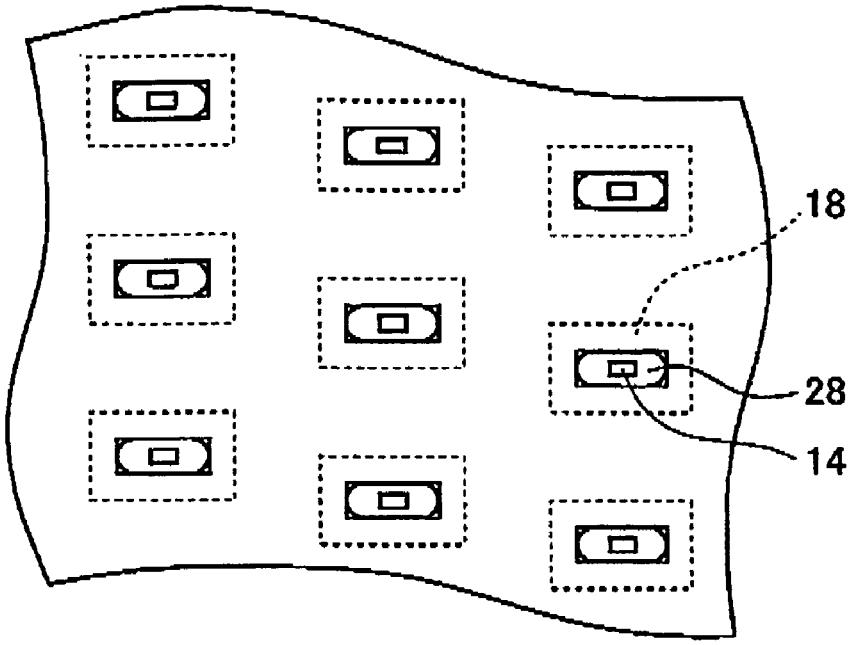
FIG. 2 schematically shows a state where multiple ejection ports are two-dimensionally arranged in an ejection port substrate of the ink jet head.

In order to perform image recording at a higher density and at high speed, the ink jet head 10 has a multi-channel structure in which multiple ejection ports (nozzles) 28 are arranged in a two-dimensional manner. In FIG. 2, a state is schematically shown in which multiple ejection ports 28 are two-dimensionally formed in the ejection port substrate 16 of the ink jet head 10. Note that in FIGS. 1A and 1B, for easy-to-understand illustration of the construction of the ink jet head, only one of the multiple ejection ports is shown.

In the ink jet head 10 according to the present invention, it is possible to freely choose the number of the ejection ports 28 and the physical arrangement position thereof. For example, the structure may be the multi channel structure of the embodiment shown in FIG. 2 or a structure having only one line of the ejection ports. The ink jet head 10 may be a so-called (full-)line head having lines of ejection ports corresponding to the whole area of the recording medium P or a so-called serial head (shuttle type head) which performs scanning in a direction perpendicular to the nozzle row direction. The ink jet head 10 of the present invention can cope with a monochrome recording apparatus and a color recording apparatus.

It should be noted here that FIG. 2 shows an arrangement of the ejection ports in a part (three rows and three columns) of the multi-channel structure and, as a preferable form, the ejection ports 28 on a row on a downstream side in a direction of ink flow are disposed so that they are displaced from the ejection ports on a row on an upstream side in the ink flow direction by a predetermined pitch in a direction perpendicular to the ink flow. By disposing the ejection ports on the row on the downstream side so that they are displaced from the ejection ports on the row on the upstream side in the direction perpendicular to the ink flow direction in this manner, it becomes possible to favorably supply the ink to the ejection ports. In the ink jet head according to the present invention, a construction may be used in which an ejection port matrix with n rows and m columns (n and m are each a positive integer), in which ejection ports on a row on the downstream side are disposed so that they are displaced from ejection ports on a row on the upstream side in the direction perpendicular to the ink flow direction, is repeatedly provided with constant cycles in the ink flow direction or a construction may be used instead in which the ejection ports are disposed so that they are successively displaced from ejection ports, which are positioned on the upstream side, in one direction (downward direction or upward direction in FIG. 2) perpendicular to the ink flow. It is possible to appropriately set the number, pitch, and repetition cycle of the ejection ports and the like in accordance with a resolution and a sending pitch.

Also, in FIG. 2, as a preferable form, the ejection ports on the row on the downstream side in the ink flow direction are disposed so that they are displaced from the ejection ports on the row on the upstream side in the direction perpendicular to the ink flow, however, the present invention is not limited to this and the ejection ports on the downstream side and the ejection ports on the upstream side may be disposed on the same straight line in the ink flow direction. In this case, it is preferable that each ejection port on each row be disposed so that it is displaced from ejection ports, which are adjacent to the ejection port in the direction vertical to the ink flow, in the ink flow direction.

In such an ink jet head 10, ink Q is used in which fine particles (hereinafter referred to as the "colorant particles") containing colorant, such as pigment, and having electrical charges are dispersed in an insulative liquid (carrier liquid). Also, an electric field is generated at the ejection port 28 through application of a drive voltage to the ejection electrode 18 provided for the ejection port substrate 16 and the ink at the ejection port 28 is ejected by means of an electrostatic force. Further, by turning on/off the drive voltage applied to the ejection electrode 18 in accordance with image data (ejection on/off), ink droplets are ejected from the ejection port 28 in accordance with the image data and an image is recorded on the recording medium p.

Hereinafter, the structure of the ink jet head 10 according to the present invention shown in FIGS. 1A and 1B will be described in more detail.

As shown in FIG. 1A, the ejection port substrate 16 of the ink jet head 10 includes an insulation substrate 32, a guard electrode 20, the ejection electrode 18, and an insulating layer 34. On a surface on an upper side in the drawing (surface opposite to a side facing the head substrate 12) of the insulation substrate 32, the guard electrode 20 and the insulating layer 34 are laminated in order. Also, for a surface on a lower side in the drawing (surface on the side facing the head substrate 12) of the insulation substrate 32, the ejection electrode 18, to which the drive voltage for ejection of the ink is applied, is formed.

Also, in the ejection port substrate 16, the ejection port 28 for ejecting an ink droplet R is formed so that it passes through the insulation substrate 32. As shown in FIG. 1B, the ejection port 28 is a cocoon-shaped opening (slit), which is narrow and long in the ink flow direction and has a shape in which both of short sides of a rectangle are formed in a semicircular shape, and has a shape in which an aspect ratio (L/D) between a length L in the ink flow direction and a length D in the direction orthogonal to the ink flow is 1 or more.

In the present invention, by setting the ejection port 28 as such an opening whose aspect ratio (L/D) between the length L in the ink flow direction and the length D in the direction orthogonal to the ink flow is 1 or more, the ink becomes easy to flow to the ejection port 28. That is, particle supplying property of the ink to the ejection port 28 is enhanced, which makes it possible to improve frequency responsiveness and also prevent clogging. This point will be described in detail later together with an action of ink droplet ejection.

Here, in this embodiment, the ejection port 28 is formed as the cocoon-shaped opening, however, the present invention is not limited to this and it is possible to form the ejection port 28 in another arbitrary shape, such as a circular shape, an approximately circular shape, an oval shape, a rectangular shape, a square shape, a rhomboid shape, or a parallelogram shape, so long as it is possible to eject the ink from the ejection port 28.

As the shape of the ejection port 28, a shape is preferable which is narrow and long in the ink flow direction and has an aspect ratio between the length in the ink flow direction and the length in the direction perpendicular to the ink flow that is 1 or more. With this construction, it becomes possible to enhance ink supplying property to the ejection port, prevent clogging, and form successive large dots on the image recording medium with stability. As a result, it becomes possible to draw a high-quality image at a higher drawing frequency. For instance, the ejection port may be formed in a rectangular shape, whose long sides extend in the ink flow direction, or an oval shape or a rhomboid shape whose long axis extends in the ink flow direction. Also, the ejection port may be formed in a trapezoidal shape with its upper base being on the upstream side of the ink flow, its lower base being on the downstream side, and its height in the ink flow direction being set longer than the lower base. In this case, it does not matter whether the side on the upstream side is longer than the side on the downstream side or the side on the downstream side is longer than the side on the upstream side. Further, a shape may be formed in which to each short side of a rectangle whose long sides extend in the ink flow direction, a circle, whose diameter is longer than the short side of the rectangle, is connected. By forming the ejection port 28 in such a shape that is narrow and long in the ink flow direction, it becomes possible to enhance ink-supplying property to the ejection port 28 and also prevent clogging. Also, it does not matter whether the ejection port 28 has a shape that is symmetrical about its center between the upstream side and the downstream side or a shape that is asymmetrical about the center therebetween.

Next, the ejection electrode formed for the ejection port substrate 16 of the ink jet head 10 shown in FIG. 1A will be described. For the lower surface (surface facing the head substrate 12) of the insulation substrate 32, the ejection electrode 18 shown in FIG. 1B is formed. The ejection electrode 18 is disposed along the rim of the ejection port 28 so that it surrounds the periphery of the ejection port 28. In FIG. 1B, the ejection electrode 18 is formed in a shape similar to the shape of the ejection port 28, however, the present invention is not limited to this and the ejection electrode 18 may be changed to various other shapes so long as the periphery of the ejection port 28 is surrounded by the ejection electrode 18. For instance, it is possible to form the ejection electrode in a circular shape, an approximately circular shape, an oval shape, or an approximately oval shape. Also, it is possible to change the ejection electrode to various other shapes in accordance with the shape of the ejection port 28 and there occurs no problem even when the periphery of the ejection port 28 is not wholly surrounded by the ejection electrode. For instance, the ejection electrode may have a shape, such as a C-letter shape or a reversed C-letter shape, in which a part of the ejection electrode on the upstream side or the downstream side in the ink flow direction is removed. Also, the ejection electrode may be parallel electrodes or approximately parallel electrodes that are parallel to each other in the ink flow direction and are disposed so that the ejection port is sandwiched therebetween.

As described above, the ink jet head 10 has a multi-channel structure in which multiple ejection ports 28 are arranged in a two-dimensional manner. Therefore, as schematically shown in FIG. 2, multiple ejection electrodes 18 are respectively disposed for the ejection ports 28 in a two-dimensional manner.

Also, the ejection electrodes 18 are exposed to the ink flow path 30 and contact the ink Q flowing in the ink flow path 30. The ink jet head shown in FIG. 1A has the structure described above, so it becomes possible to significantly improve ejection property of ink droplets. This point will be described in detail later together with an action of ejection. Here, the ejection electrode 18 is not necessarily required to be exposed to the ink flow path 30 and contact the ink. For instance, the ejection electrode 18 may be formed in the ejection port substrate 16 or a surface of the ejection electrode 18 shown in FIG. 1A exposed to the ink flow path may be covered with an insulating layer.

Also, as shown in FIG. 1A, the ejection electrode 18 is connected to a drive voltage control portion 33. The drive voltage control portion 33 is capable of controlling drive voltages applied to the ejection electrode at the time of ejection of the ink and at the time of non-ejection of the ink in accordance with a drawing signal.

Figure 3:
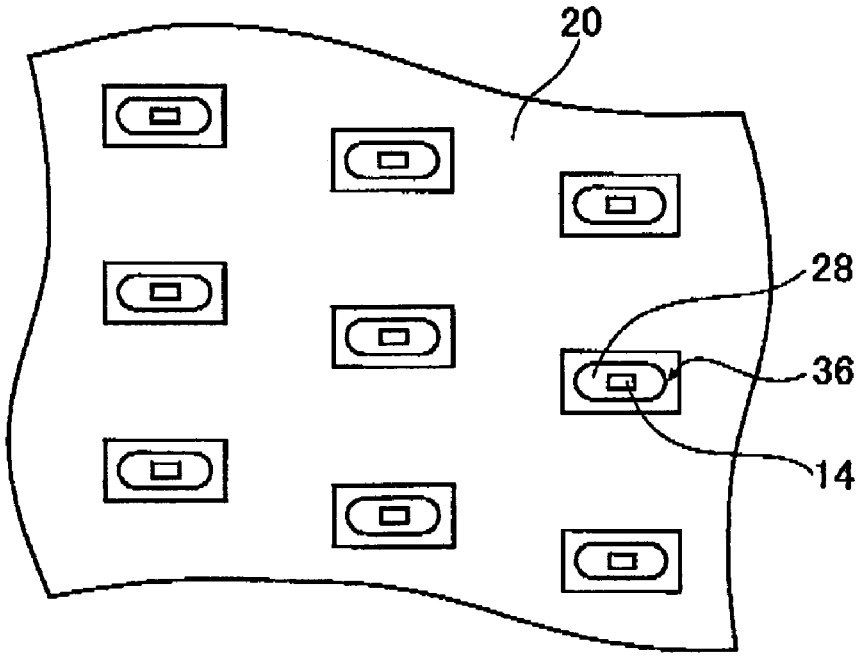
FIG. 3 schematically shows a planar structure of a guard electrode of an ink jet head having a multi-channel structure.

Next, the guard electrode 20 of the ink jet head 10 shown in FIG. 1A will be described. As shown in FIG. 1A, the guard electrode 20 is formed on a surface of the insulation substrate 32 and a surface of the guard electrode 20 is covered with the insulating layer 34. In FIG. 3, a planar structure of the guard electrode 20 is schematically shown. FIG. 3 is an arrow view taken along line III-III in FIG. 1A and schematically shows the planar structure of the guard electrode 20 of the ink jet head 10 having the multi-channel structure. As shown in FIG. 3, the guard electrode 20 is a sheet-shaped electrode, such as a metallic plate, which is common to each ejection electrode and has openings 36 at positions corresponding to the ejection electrodes 18 respectively formed on the peripheries of the ejection openings 28 arranged in a two-dimensional manner. Each opening 36 of the guard electrode 20 is formed in a rectangular shape that is similar to the shape of the ejection port 28. The opening 36 of the guard electrode 20 is formed so that it has a length and width exceeding the length and width of the ejection port 28.

It is possible for the guard electrode 20 to suppress electric field interference by shielding against electric lines of force between adjacent ejection electrodes 18. The guard electrode 20 is connected to a guard electrode control portion 35 and a predetermined AC bias voltage synchronized with the frequency of the drawing signal is applied to the guard electrode 20 by the guard electrode control portion 35. Through the application of the AC bias voltage to the guard electrode 20 at the time of a recording operation of the ink jet head, concentratability and ejection property of the ink are controlled. A method of controlling the AC bias voltage applied to the guard electrode 20 will be described in detail later.

Preferably, as shown in FIG. 1A, the guard electrode 20 is formed in the layer different from that containing the ejection electrodes 18, and moreover, its whole surface is covered with the insulating layer 34. The surface of the guard electrode 20 is covered with the insulating layer 34, thereby making it possible to prevent the contact of the ink leaked from the ejection ports with guard electrodes.

The ink jet head 10 has the insulating layer 34, whereby the electric field interference between the adjacent ejection electrodes 18 can be suitably prevented, and the colorant particles of the ink Q can be prevented from being deposited to cause the discharge between the ejection electrodes 18 and the guard electrode 20.

Here, the guard electrode 20 needs to be provided so as to shield against the electric lines of force of the ejection electrodes 18 provided on other ejection ports 28 (hereinafter referred to as "other channels") and the electric lines of force directed to the other channels while ensuring the electric lines of force acting on the corresponding ejection port 28 (hereinafter referred to as "own channel" for convenience) among the electric lines of force generated from the ejection electrodes 18.

When the guard electrode 20 is not provided, at the time of ejection of ink droplets, electric lines of force generated from the edge portion on an ejection port side of the ejection electrode 18 (hereinafter referred to as the "inner edge portion of the ejection electrode") converge inside the ejection electrode 18, that is, in an area surrounded by the inner edge portion of the ejection electrode 18, act on the own channel, and generate an electric field necessary for the ink droplet ejection. On the other hand, electric lines of force generated from the edge portion on a side opposite to the ejection port side of the ejection electrode 18 (hereinafter referred to as the "outer edge portion of the ejection electrode") diverge further outside from the outer edge portion of the ejection electrode 18, exert influence on other channels, and cause electric field interference.

If the above points are taken into consideration, the width and length of the opening 36 of the guard electrode 20, when the substrate plane is viewed from above, is preferably made larger than the width and length of the ejection electrode 18 of the own channel to avoid shielding against the electric lines of force directed to the own channel. Specifically, the end portion of the guard electrode 20 on the ejection port 28 side is preferably more spaced apart (retracted) from the ejection port 28 than the inner edge portion of the ejection electrode 18 of the own channel.

In addition, for the efficient shielding against the electric lines of force directed to the other channels, the length and width of the opening 36 of the guard electrode 20, when the substrate plane is viewed from above, is preferably made smaller than the spacing between the outer edge portions (outer diameter) of the ejection electrode 18 of the own channel. Specifically, the inner edge portion of the guard electrode 20 is preferably closer (advanced) to the ejection port 28 than the outer edge portion of the ejection electrode 18 of the own channel. According to the studies made by the inventor of the present invention, the distance between the outer edge portion of the ejection electrode 18 and the inner edge portion of the guard electrode 20 is preferably equal to or larger than 5 μm, more preferably equal to or larger than 10 μm.

With the above construction, the stable ejection of the ink droplets from the ejection port 28 is ensured, variations in the ink adhering position due to the electric field interference between the adjacent channels can be suitably suppressed, and thus a high-quality image can be consistently recorded.

The guard electrode 20 may be provided (that is, the opening 36 of the guard electrode 20 may be formed) so that the shape of the opening 36 of the guard electrode 20 is made substantially similar to the shape formed by the inner edge portion or the outer edge portion of the ejection electrode 18, and the inner edge portion of the guard electrode 20 is more spaced apart (retracted) from the ejection port 28 than the inner edge portion of the ejection electrode 18 of the own channel and is closer (advanced) to the ejection port 28 than the outer edge portion of the ejection electrode.

Also, in the above example, the guard electrode 20 is made as a sheet-shaped electrode that is common to each ejection electrode 18, however, the present invention is not limited to this and the guard electrode 20 may have any other shapes or structures so long as it is possible to shield the respective ejection ports against electric lines of force of other channels. For instance, the guard electrode may be provided between respective ejection ports in a mesh shape. Also, when the intervals between the adjacent ejection ports in the row direction and the intervals between the adjacent ejection ports in the column direction are different from each other in the matrix of the multiple ejection ports, for instance, a construction may be used in which the guard electrode is not provided between ejection ports, which are separated from each other by a degree by which no electric field interference will occur, and the guard electrode is provided only between ejection ports that are close to each other. Also, there occurs no problem even when the structure is not used in which the guard electrode is common to each ejection electrode disposed in the matrix manner. For instance, a structure may be used instead in which the guard electrode is common in units of rows, columns, or staggered arrangements of the ejection electrodes arranged in matrix. In this case, multiple guard electrode control portions may be respectively provided for the guard electrodes provided commonly in units of rows, columns, or staggered arrangements of the ejection electrodes arranged in the matrix manner or each guard electrode may be connected to the same guard electrode control portion and be controlled individually or commonly. Here, the term "common" refers to a concept containing not only a structurally common state but also an electrically common state. Therefore, even in the case of a structure in which the guard electrodes are structurally independent of each other, when the guard electrodes are electrically connected and a common state is obtained, the "common" concept described above is satisfied.

Regardless of which one of the guard electrode shapes described above is adopted, it is sufficient that as shown in FIG. 1A, the guard electrode 20 is formed so that the inner edge portion of the guard electrode 20 is more apart from the ejection port 28 than the inner edge portion of the ejection electrode 18 of an own channel and is closer to the ejection port 28 than the outer edge portion of the ejection electrode 18.

In this embodiment, the shape of the opening 36 of the guard electrode 20 is set approximately the same as the shape of the ejection port 28, however, the present invention is not limited to this and the opening 36 of the guard electrode 20 may have another arbitrary shape so long as it is possible to prevent electric field interference by shielding against electric lines of force between adjacent ejection electrodes 18. For instance, it is possible to form the opening 36 of the guard electrode 20 in a circular shape, an oval shape, a square shape, or a rhomboid shape.

Next, the ink guide 14 of the ink jet head 10 shown in FIG. 1A will be described. The ink guide 14 is produced from a ceramic-made flat plate having a predetermined thickness and is disposed on the head substrate 12 for each ejection port 28 (ejection portion). The ink guide 14 is formed so that it has a somewhat wide width in accordance with the length of the ejection port 28 in a long-side direction. As described above, the ink guide 14 passes through the ejection port 28 and its tip end portion 14*a* protrudes upwardly from a surface on a recording medium P side of the ejection port substrate 16 (surface of the insulating layer 34).

The tip end portion 14*a* of the ink guide 14 is formed so that it has an approximately triangular shape (or a trapezoidal shape) in which a cross-section parallel to the ink flow direction forms a shape that is gradually narrowed as a distance to a counter electrode 24 side is reduced. The ink guide 14 is disposed so that a surface of the tip end portion 14*a* is inclined in the ink flow direction. With this construction, the ink flowing into the ejection port 28 moves along the inclined surface of the tip end portion 14*a* of the ink guide 14 and reaches the vertex of the tip end portion 14*a*, so a meniscus of the ink is formed at the ejection port 28 with stability.

Also, by forming the ink guide 14 so that it is wide in the long-side direction of the ejection port 28, it becomes possible to reduce a width in the direction orthogonal to the ink flow and reduce influence on the ink flow, which makes it possible to form the meniscus to be described later with stability.

It should be noted here that the shape of the ink guide 14 is not specifically limited so long as it is possible to cause the colorant in the ink Q to pass through the ejection port 28 of the ejection port substrate 16 and be concentrated at the tip end portion 14*a*. For instance, it is possible to change the shape of the ink guide 14 as appropriate to a shape other than the shape in which the tip end portion 14*a* is gradually narrowed toward the counter electrode. For instance, a slit serving as an ink guide groove that gathers the ink Q to the tip end portion 14*a* by means of a capillary phenomenon may be formed in a center portion of the ink guide 14 in a vertical direction in the drawing. Also, a plate-like shape that is long in the ink flow direction is used in accordance with the shape of the ejection port, however, the present invention is not limited to this and a prismatic shape may be used instead.

Also, it is preferable that a metal be evaporated onto the extreme tip end portion of the ink guide 14 because the dielectric constant of the tip end portion 14*a* of the ink guide 14 is substantially increased through the evaporation of the metal onto the extreme tip end portion of the ink guide 14. As a result, when a drive voltage is applied to the ejection electrode, a strong electric field is generated at the ink guide 14 with ease, which makes it possible to improve ejection property of the ink.

In the ink jet head 10 in this embodiment, as shown in FIG. 1A, as a preferable form, ink guide dikes 40 that induce the ink to the ejection port 28 are provided for the head substrate 12. The ink guide dikes 40 will be described in detail below with reference to FIGS. 4A and 4B.

Figure 4A:
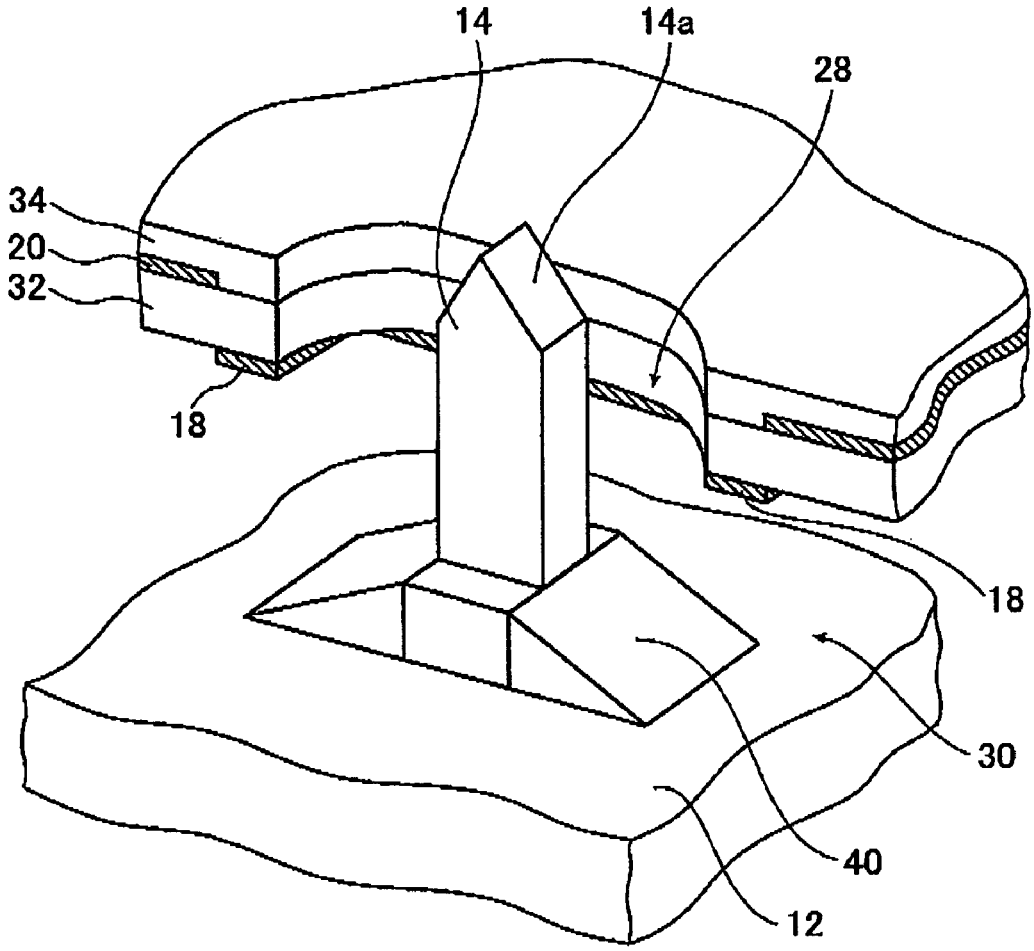
FIGS. 4A and 4B are each a schematic perspective view and a cross-sectional view for explanation of a structure of an ink guide dike shown in FIG. 1A.

FIG. 4A is a partial cross sectional perspective view showing a construction of the vicinity of the ejection portion in the ink jet head 10 shown in FIG. 1. In the figure, in order to demonstrate clearly the structure of the ink guide dike 40, the ejection port substrate 16 is cut off in a nearly central position of the ink guide 14 along a direction of the ink flow.

The ink guide dikes 40 are respectively provided on upstream and downstream sides of the ink guide 14 in the direction of the ink flow (the direction indicated by an arrow in FIG. 1A) on a surface on the ink flow path 30 side of the head substrate 12, i.e., on a bottom face of the ink flow path 30. Also, each ink guide dike 40 has a surface which inclines so as to become gradually closer to the ejection port substrate 16 from the vicinity of the position corresponding to the ejection port 28 toward the position corresponding to the center of the ejection port 28 with respect to the direction of the ink flow. That is to say, each ink guide dike 40 has such a shape as to incline toward the ejection port 28 along the direction of the ink flow.

In addition, each ink guide dike 40 is constructed so as to have nearly the same width as that of the ejection port 28 in a direction intersecting perpendicularly the direction of the ink flow, and have a side wall which is erected from the bottom face. In addition, the ink guide dikes 40 are provided at a predetermined distance from the surface of the ejection port substrate 16 on the ink flow path 30 side, i.e., the upper surface of the ink flow path 30 so as to ensure the flow path of the ink Q without blocking up the ejection port 28. Such ink guide dikes 40 are provided for each ejection portion.

The ink guide dikes 40 inclining toward the ejection port 28 are provided on the bottom face of the ink flow path 30 along the direction of the ink flow, whereby the ink flow directed to the ejection port 28 is formed and hence the ink Q is guided to the opening portion of the ejection port 28 on the side of the ink flow path 30. Thus, it is possible to suitably make the ink Q to flow into the inside of the ejection port 28, and it is also possible to enhance the particle supplying property of the ink Q. Further, it is possible to more surely prevent the ejection port 28 from being clogged.

Figure 4B:
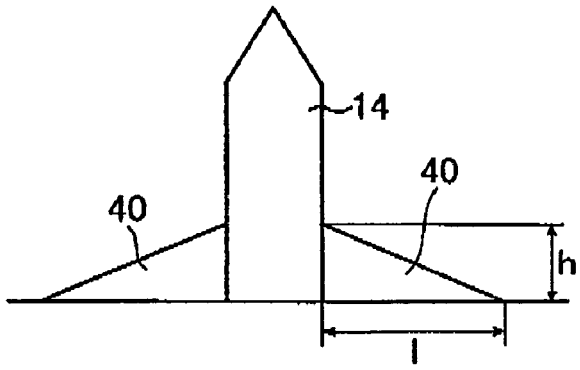

A length l of the ink guide dike 40 in the direction of the ink flow has to be suitably set so as to suitably guide the ink Q to the ejection port 28 within a range of not interfering with any of the adjacent ejection ports. Thus, as shown in FIG. 4B, the length l of the ink guide dike 40 is preferably 3 or more times as large as a height h ($l/h \geqq 3$) of a highest portion of the ink guide dike 40, and is more preferably 8 or more times as large as the height h ($l/h \geqq 8$) of the highest portion of the ink guide dike 40.

A width of the ink guide dike 40 in the direction intersecting perpendicularly the direction of the ink flow is preferably equal to that of the ejection port 28 or slightly wider than that of the ejection port 28. In addition, the ink guide dike 40 is not limited to the illustrated example having a uniform width. Thus, there may also be adopted an ink guide dike having a gradually decreasing width, an ink guide dike having a gradually increasing width, or the like. In addition, each side wall of the ink guide dike 40 is not limited to the vertical plane, and hence may also be an inclined plane or the like.

An inclined plane (ink guide surface) of the ink guide dike 40 must have a shape which is suitable for guiding the ink Q to the ejection port 28. Thus, a slope having a fixed angle of inclination may be adopted for the inclined plane of the ink guide dike 40. Or, a surface having a changing angle of inclination, or a curved surface may also be adopted for the inclined plane of the ink guide dike 40. In addition, the surface of the inclined plane of the ink guide dike 40 is not limited to a smooth surface. Thus, one or more ridges, grooves, or the like may be formed along the direction of the ink flow, or radially toward the central portion of the ejection port 28 on the inclined plane of the ink guide dike 40.

In addition, the upper portion of the ink guide dike 40 and the ink guide 14 may also be smoothly connected to each other without creating a step in the vicinity of a connection portion between the upper portion of the ink guide dike 40 and the ink guide 14 as in the illustrated example.

In the illustrated example, there is adopted a form in which the ink guide dikes 40 are disposed on the upstream and downstream sides of the ink guide 14, respectively. However, alternatively, there may also be adopted a form in which a trapezoidal ink guide dike 40 having slopes on the upstream and downstream sides of the ejection port 28, respectively, is provided, and the ink guide 14 is erected on the upper portion of this trapezoidal ink guide dike 40. Or, the ink guide 14 and the ink guide dike 40 may also be formed integrally with each other. As described above, the ink guide dike 40 may be formed separately from or integrally with the ink guide 14 to be mounted to the head substrate 12, or may also be formed by digging the head substrate 12 using the conventionally known digging means.

It should be noted that while the ink guide dike 40 has to be provided on the upstream side of the ejection port 28, as in the illustrated example, the ink guide dike 40 is preferably provided on the downstream side as well of the ejection port 28 so that its height in the direction of ejection of the ink droplet R becomes lower with increasing a distance from the ejection port 28. As a result, the ink Q which has been guided toward the ejection port 28 by the ink guide dike 40 on the upstream side smoothly flows into the downstream side. Hence, the stability of the ink flow can be held and also the stability of ejection of the ink Q can be maintained without a turbulent flow of the ink Q.

In the example shown in FIG. 4A, the ink guide dikes 40 are disposed on the upper surface of the head substrate 12. However, the present invention is not limited to this and there may also be adopted a construction in which an ink flow groove is provided in the head substrate 12, and the ink guide dikes as shown in FIG. 4A are disposed inside the ink flow groove.

For example, as shown in FIG. 1A, the ink flow groove having a predetermined depth is provided on the upper surface of the head substrate 12 so as to extend through a position corresponding to the ejection port 28 along the direction of the ink flow. Further, there are provided ink guide dikes having the surfaces inclining toward the ejection port 28 along the direction of the ink flow in the position corresponding to the ejection port 28 of the ink groove. In such a manner, the provision of the ink flow groove on the head substrate makes it possible to make most of the ink flowing through the ink flow path 30 to selectively flow in the ink flow groove. Further, the ink guide dikes 40 as shown in FIG. 4 are provided in a position of the ink flow groove. As a result, the ink flowing through the ink flow groove can be made to suitably flow into the inside of the ejection port 28, and hence it is possible to enhance the supplying property of the ink to the tip portion 14*a* of the ink guide 14.

Next, the counter electrode 24 disposed so as to face the surface of the ink jet head 10 from which the ink droplets R are to be ejected will be described. As shown in FIG. 1A, the counter electrode 24 is disposed so as to face the tip end portion 14*a* of the ink guide 14, and includes an electrode substrate 24*a* which is grounded and an insulating sheet 24*b* which is disposed on a lower surface of the electrode substrate 24*a* in FIG. 1A, that is, on a surface of the electrode substrate 24*a* on the side of the ink jet head 10.

The recording medium P is supported on the lower surface of the counter electrode 24 in FIG. 1A, that is, on the surface of the insulating sheet 24*b* by electrostatic attraction for example. The counter electrode 24 (the insulating sheet 24*b*) functions as a platen for the recording medium P.

At least during recording, the recording medium P held on the insulating sheet 24*b* of the counter electrode 24 is charged by the charge unit 26 to a predetermined negative high voltage opposite in polarity to that of the drive voltage applied to the ejection electrode 18. As a result, the recording medium P is charged negative to be biased to the negative high voltage to function as the substantial counter electrode to the ejection electrode 18, and is electrostatically attracted to the insulating sheet 24*b* of the counter electrode 24.

The charge unit 26 includes a scorotron charger 26*a* for charging the recording medium P to a negative high voltage, and a bias voltage source 26*b* for supplying a negative high voltage to the scorotron charger 26*a*. Note that the charge means of the charge unit 26 used in the present invention is not limited to the scorotron charger 26*a*, and hence various discharge means such as a corotron charger, a solid-state charger and an electrostatic discharge needle can be used.

In addition, in the illustrated embodiment, the counter electrode 24 includes the electrode substrate 24*a* and the insulating sheet 24*b*, and the charge unit 26 is used to charge the recording medium P to a negative high voltage to apply a bias voltage to the medium P so that the medium P functions as the counter electrode and is electrostatically attracted to the surface of the insulating sheet 24*b*. However, this is not the sole case of the present invention and another configuration is also possible in which the counter electrode 24 is constituted only by the electrode substrate 24*a*, and the counter electrode 24 (the electrode substrate 24*a*) is connected to a bias voltage source for supplying a negative high voltage and is always biased to the negative high voltage so that the recording medium P is electrostatically attracted to the surface of the counter electrode 24.

Further, the electrostatic attraction of the recording medium P to the counter electrode 24, the charge of the recording medium P to the negative high voltage, and the application of the negative high bias voltage to the counter electrode 24 may be performed using separate negative high voltage sources. Also, the support of the recording medium P by the counter electrode 24 is not limited to the utilization of the electrostatic attraction of the recording medium P, and hence any other supporting method or supporting means may be used for the support of the recording medium P by the counter electrode 24.

Hereinabove, the structure of the ink jet head 10 according to the present invention has been described in detail. Next, an ink ejection operation of the ink jet head having the structure described above will be described with reference to FIGS. 1A and 1B and FIG. 5. Note that a case will be described as an example in which the polarity of the colorant particles is positive, however, when the polarity of the colorant particles is opposite, that is, negative, each voltage value is reversed in polarity.

Figure 5:
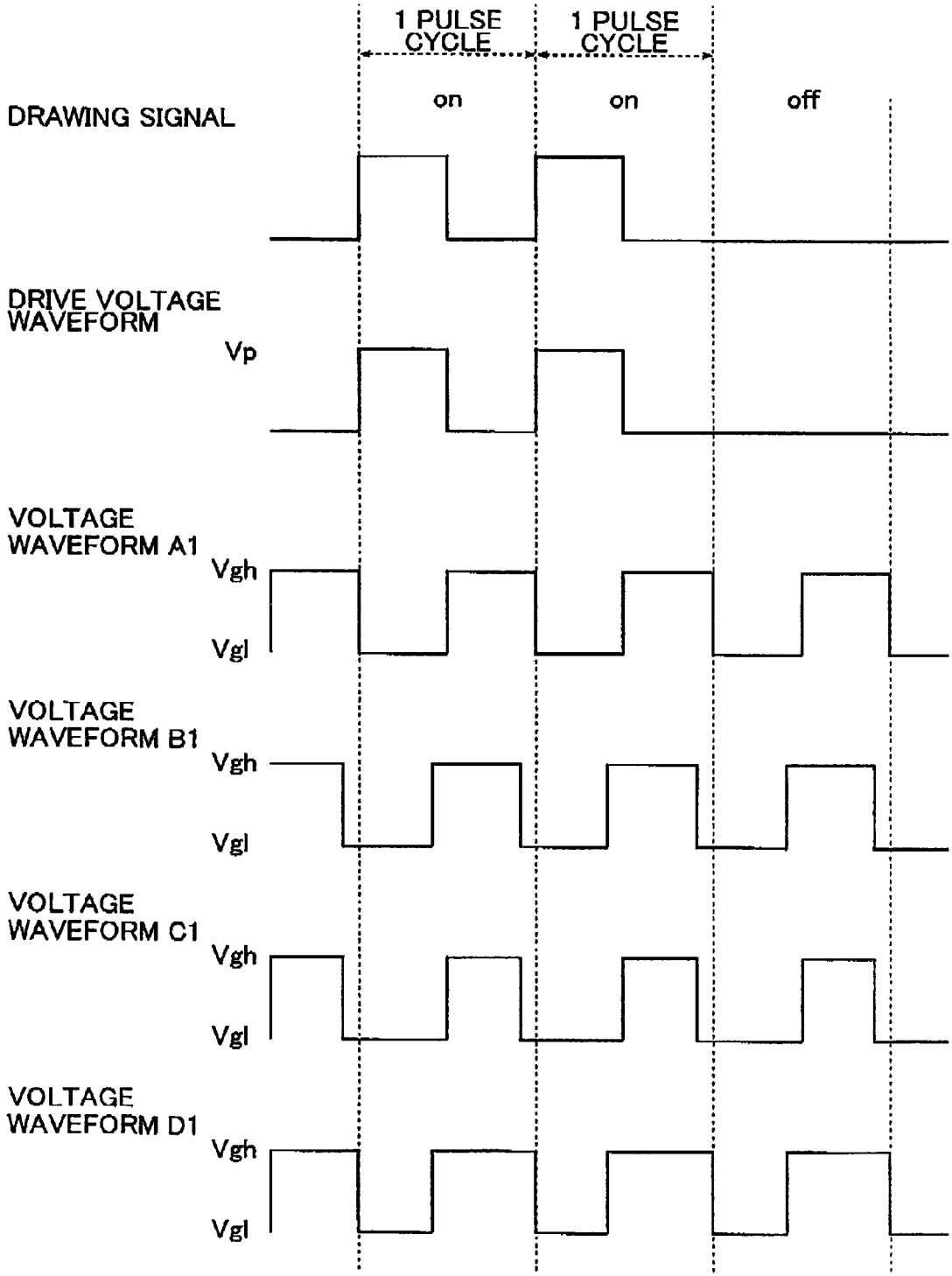
FIG. 5 schematically shows relations among a drawing signal, a voltage waveform of drive voltages applied to ejection electrodes, and voltage waveforms of a pulse voltage applied to a guard electrode in the control method according to the present invention.

In FIG. 5, a waveform of a drawing signal (ejection data signal) such as image data or print data, a waveform (pulse waveform) of the drive voltage applied to the ejection electrode, and voltage waveforms A1 to D1 of the AC bias voltage applied to the guard electrode are shown. The drawing signal shown on the top level in FIG. 5 is used for designation of ejection and non-ejection of the ink and the ink ejection is controlled based on the drawing signal. As shown in FIG. 5, the cycle and pulse width of the drive voltage (pulse voltage) applied to the ejection electrode are the same as the cycle and pulse width of the drawing signal. Also, the drive voltage Vp applied to the ejection electrode 18 is set at 600 [V], for instance. When the drive voltage is not applied to the ejection electrode 18, the ejection electrode 18 is set at 0 [V], for instance. The voltage value of the drive voltage is not limited to the value described above and may be changed to another arbitrary voltage value so long as it is possible to eject the ink with reliability through application of the drive voltage to the ejection electrode 18.

At the time of a recording operation of the ink jet head shown in FIG. 1A, the drive voltage is applied to the ejection electrode 18 at timings indicated by the drive voltage waveform in FIG. 5. That is, in synchronization with the drawing signal, the drive voltage for ejecting the ink is applied to the ejection electrode 18. When the drawing signal designating ejection of the ink (signal indicated with "on" in FIG. 5) is supplied to the drive voltage control portion 33 connected to the ejection electrode 18, the drive voltage is applied to the ejection electrode 18 at the same timing as the drawing signal. As a result, an electric field acting on the ejection of the ink is generated from the ejection electrode 18 and the ink is ejected from the ejection port 28.

On the other hand, when the drawing signal designating non-ejection of the ink (signal indicated with "off" in FIG. 5) is supplied to the drive voltage control portion, no drive voltage is applied to the ejection electrode 18 and the ejection electrode 18 is set at 0 [V]. Therefore, no electric field for ejection is generated from the ejection electrode 18 and the ink is not ejected from the ejection port 28. Note that the ink ejection action of the ink jet head 10 will be described in detail later. In FIG. 5, one cycle of the drawing signal corresponds to a time necessary for formation of one dot or one pixel on the recording medium.

In the drive voltage waveform shown in FIG. 5, the pulse width of the drive voltage is set as the same as the pulse width of the drawing signal. However, the present invention is not limited to this and the pulse width of the drive voltage may be set longer or shorter than the pulse width of the drawing signal. When the pulse width of the drive voltage applied to the ejection electrode 18, that is, the application time of the drive voltage is adjusted to be elongated or shorted in this manner, it becomes possible to adjust the amount of the ink ejected from the ejection port 28, which makes it possible to adjust the gradation of one pixel formed on the recording medium.

Figure 6A:
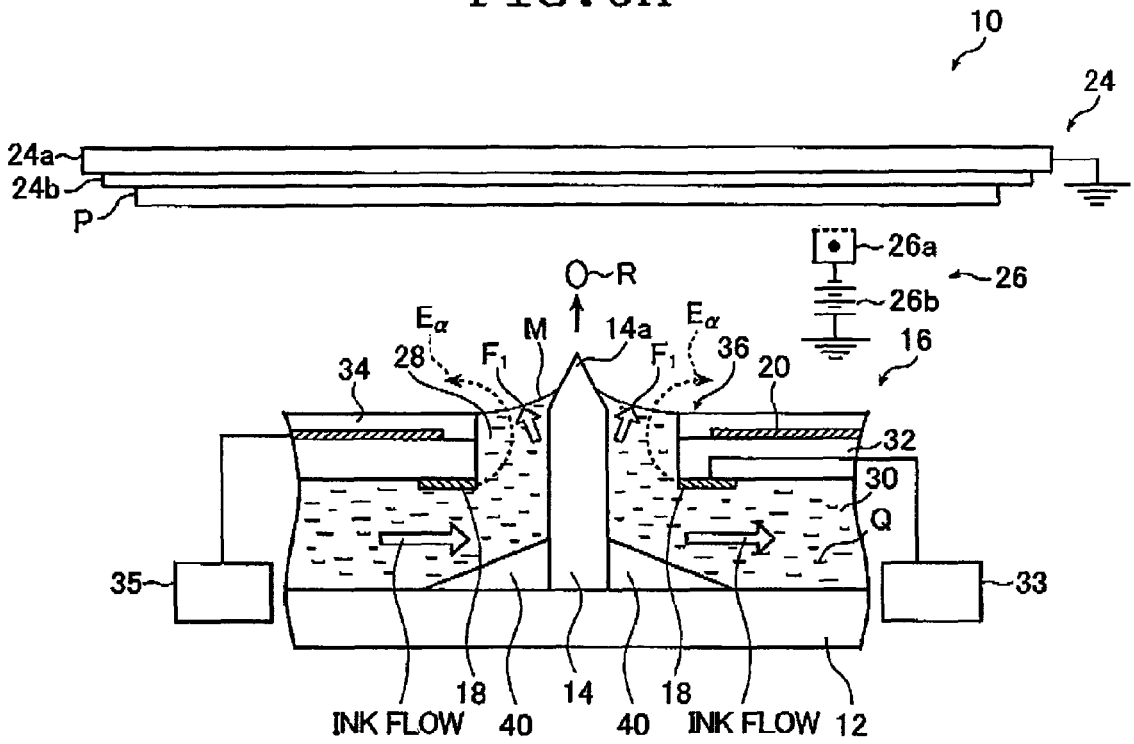
FIG. 6A schematically shows a state of the ejection port when the drive voltage is applied to the ejection electrode.
Figure 6B:
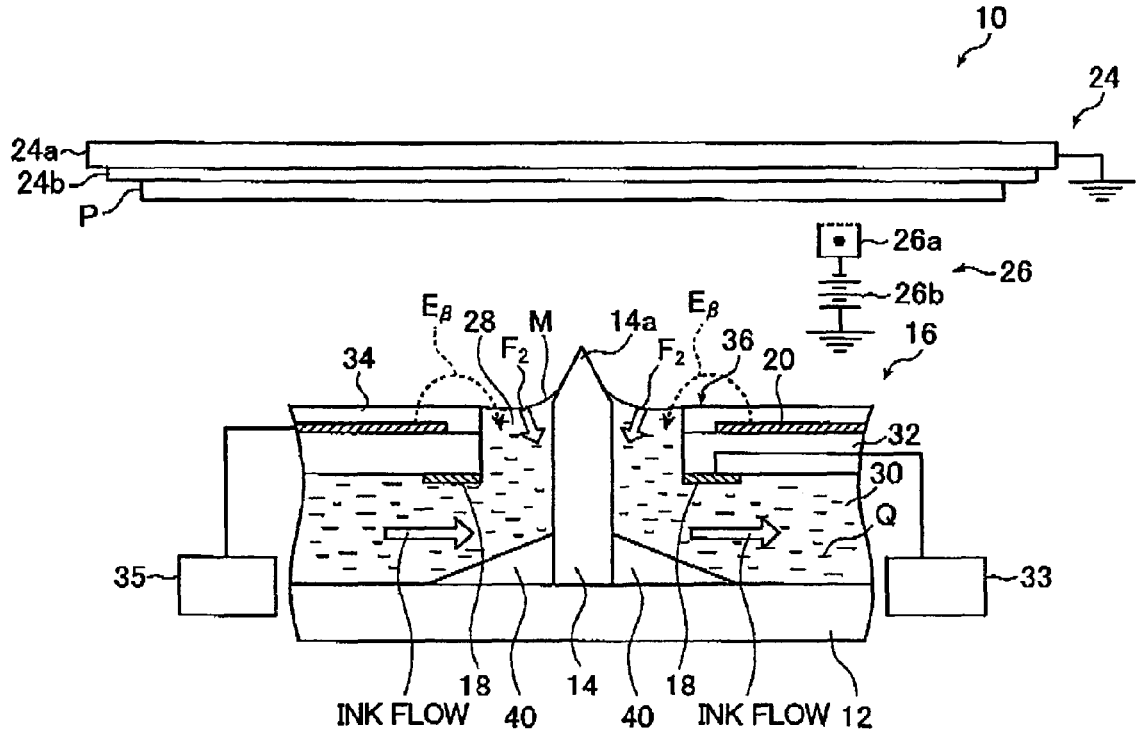
FIG. 6B schematically shows a state of the ejection port when the drive voltage is not applied to the ejection electrode (or when a low voltage is applied thereto)

Next, the AC bias voltage applied to the guard electrode 20 at the time of the recording operation will be described with reference to FIGS. 1A, 5, 6A, and 6B. The voltage waveforms A1 to D1 shown in FIG. 5 are each an example of the AC bias voltage applied to the guard electrode 20. FIG. 6A schematically shows a state of the ejection port 28 in the case where the drive voltage is applied to the ejection electrode 18 and FIG. 6B schematically shows a state of the ejection port 28 in the case where the drive voltage is not applied to the ejection electrode 18 (or in the case where a low voltage is applied thereto).

First, an operation in the case where the AC bias voltage is applied to the guard electrode 20 in accordance with the voltage waveform A1 will be described. Note that in the following description, the voltage waveform of the AC bias voltage (pulse voltage) applied to the guard electrode 20 is generated at the guard electrode control portion 35 connected to the guard electrode 20. As shown in FIG. 1, an AC bias voltage, which has the same frequency as the signal of the drive voltage applied to the ejection electrode 18 and whose phase is delayed by 180° from that of the drive voltage signal, is applied to the guard electrode in accordance with the voltage waveform A1. In other words, an AC bias voltage signal having a phase opposite to that of the drive voltage signal applied to the ejection electrode 18 is applied to the guard electrode 20. A high voltage value $V_{gh}$ of the AC bias voltage is set at 400 [V] and a low voltage value $V_{gl}$ thereof is set at 100 [V], for instance. To the guard electrode 20, the high voltage $V_{gh}$ and the low voltage $V_{gl}$ are alternately applied with constant cycles regardless of whether ink ejection is performed or not.

When the AC bias voltage applied to the guard electrode 20 is controlled in accordance with the voltage waveform A1 shown in FIG. 5, during the application of the drive voltage to the ejection electrode 18, that is, during the ink ejection (hereinafter referred to as the "ink ejection time"), the bias voltage that is the low voltage is applied to the guard electrode 20. Under this state, at the ejection port 28, an electric field $E_\alpha$ according to the voltage difference between the ejection electrode 18 and the guard electrode 20 is formed. Since the ejection electrode 18 is at higher voltage level than the guard electrode 20, as shown in FIG. 6A mentioned above, an electrostatic force $F_1$ directed toward the counter electrode 24 (ink ejection direction) is exerted on the colorant particles in the ink at the ejection port 28 by means of the electric field $E_\alpha$ directed from the ejection electrode 18 to the guard electrode 20. As a result, the position of the meniscus M of the ink at the ejection port 28 rises toward the counter electrode 24 and a state is obtained in which the ink is easily ejected. Then, the ink at the tip end portion 14*a* of the ink guide 14 is attracted by an attractive force from the counter electrode 24 and a part of the ink is ejected toward the counter electrode 24 as an ink droplet. As a result, a dot of the ink droplet is formed on a surface of the recording medium disposed on the counter electrode 24. The bias voltage that is the low voltage is applied to the guard electrode 20 concurrently with the application of the drive voltage to the ejection electrode 18 in this manner to obtain a state in which the ink is easily ejected, so that the ink is ejected swiftly without delay of ejection of ink droplets, and the ejection responsiveness is thus increased.

On the other hand, as indicated by the voltage waveform A1 in FIG. 5, when the application of the drive voltage to the ejection electrode 18 is ended and the ejection electrode 18 is set at 0 [V] (hereinafter referred to as the "stop time"), the AC bias voltage is changed from the low voltage to the high voltage. In other words, the bias voltage that is the high voltage is applied to the guard electrode 20. Under this state, at the ejection port 28, an electric field $E_\beta$ according to the voltage difference between the ejection electrode 18 and the guard electrode 20 is formed. Here, since the guard electrode 20 is at higher voltage level than the ejection electrode 18, an electrostatic force $F_2$ in a direction opposite to the direction toward the counter electrode 24 is exerted on the colorant particles contained in the ink at the ejection port 28 by means of the electric field $E_\beta$ directed from the ejection electrode 18 to the guard electrode 20. Therefore, the position of the meniscus M of the ink at the ejection port 28 is pressed to an ink flow path 30 side (in the downward direction in FIG. 6B) as compared with the case where the electrostatic force $F_1$ directed toward the counter electrode 24 is exerted, so the state is maintained, in which ink droplets are not easily ejected from the ejection port 28. By applying the bias voltage of the high voltage to guard electrode 20 concurrently with the setting of the drive voltage applied to the ejection electrode 18 at 0 [V] (low voltage level) to maintain the state, in which the ink is hard to eject from the ejection port 28, it is made possible to enhance the ink ejection property.

As described above, when the AC bias voltage is applied to the guard electrode 20 based on the voltage waveform A1 in FIG. 5, the bias voltage that is the high voltage is applied to the guard electrode 20 before the ejection of the ink, so the electrostatic force in the direction opposite to the direction toward the counter electrode 24 is exerted on the meniscus M of the ink at the ejection port 28 and the state is obtained, in which the ink is hard to eject. On the other hand, at the time of ejection of the ink, the drive voltage is applied to the ejection electrode 18 and the bias voltage that is the low voltage is applied to the guard electrode 20, which results in a situation in which the electrostatic force directed to the counter electrode 24 is exerted on the meniscus M of the ink at the ejection port 28. By controlling the AC bias voltage applied to the guard electrode 20 in this manner, it becomes possible to press the meniscus of the ink by means of the electrostatic force in the direction opposite to the direction toward the counter electrode so that the ink will not be ejected from the ejection port 28 unless the drive voltage is applied to the ejection electrode 18. Then, concurrently with or approximately concurrently with the application of the drive voltage, the meniscus of the ink at the ejection port 28 is released from the pressed state. As a result, concurrently with or approximately concurrently with the application of the drive voltage to the ejection electrode 18, the ink can be swiftly ejected from the ejection port 28.

Also, when the AC bias voltage having the voltage waveform A1 is applied to the guard electrode 20, it becomes possible to control the ejection and non-ejection of the ink with reliability even when the drive voltage applied to the ejection electrode 18 is low. Therefore, even when the drive voltage applied to the ejection electrode is low, a difference in ejection property between when the ejection is ON and when the ejection is OFF is greatly increased as compare with the conventional case. Consequently, it becomes possible to stably eject ink at a low drive voltage and further increase the frequency of the drive voltage.

Further, the AC bias voltage is applied even at the time of non-ejection of the ink, so the colorant particles in the ink at the ejection port 28 are oscillated, which makes it possible to prevent clogging due to overconcentration of the ink.

As can be understood from the above description, the state of the meniscus of the ink formed at the ejection port 28 depends on the drive voltage applied to the ejection electrode 18 but basically changes in accordance with the magnitude of the bias voltage applied to the guard electrode 20. In other words, when the bias voltage applied to the guard electrode 20 is increased, an electric field generated from the guard electrode 20 is strengthened, so an electrostatic force acting on the ink at the ejection port 28 is also strengthened. As a result, the meniscus of the ink formed at the ejection port 28 is pressed to an ink flow path 30 side and the ink at the ejection port 28 is placed under a hard-to-eject state. On the other hand, when the bias voltage applied to the guard electrode 20 is decreased, the electric field generated from the guard electrode 20 is weakened and the electrostatic force acting on the ink is also weakened. As a result, the meniscus of the ink formed at the ejection port 28 is released from the pressed state and the ink becomes easy to eject from the ejection port 28. As described above, according to the present invention, the state of the meniscus of the ink formed at the ejection port 28 is adjusted to control the ejection property of the ink by applying the AC bias voltage to the guard electrode 20 and controlling the AC bias voltage. As described above, in addition to the function of preventing electric field interference between adjacent ejection electrodes, the guard electrode 20 also has a function of adjusting the ejection property of the ink by adjusting the state of the meniscus formed at the ejection port through the application of the AC bias voltage.

Next, an operation in the case where the AC bias voltage is applied to the guard electrode 20 in accordance with the voltage waveform B1 shown in FIG. 5 will be described. The voltage waveform B1 shown in FIG. 5 is a case where the phase of the AC bias voltage differs from that of the drive voltage signal applied to the ejection electrode 18 and is advanced from that in the case of the voltage waveform A1. In the voltage waveform B1, falling of the AC bias voltage applied to the guard electrode 20 precedes rising of the drive voltage. Also, rising of the AC bias voltage precedes falling of the drive voltage in a like manner.

When the AC bias voltage is applied to the guard electrode 20 in accordance with the voltage waveform B1, prior to the application of the drive voltage to the ejection electrode 18, the bias voltage that is the low voltage is applied to the guard electrode 20. As a result, the ink at the ejection port 28 before ink ejection is placed under a state in which the ink is easy to eject from the ejection port 28 as compared with a case where the bias voltage that is the high voltage is applied to the guard electrode 20. Then, the drive voltage for ejecting the ink is applied to the ejection electrode 18 under this state, so the ink is ejected from the ejection port 28 concurrently with or approximately concurrently with the application of the drive voltage. The ink is placed under an easy-to-eject state by applying the bias voltage that is the low voltage to the guard electrode 20 prior to the ejection of the ink in the manner described above, so it becomes possible to prevent delay of ink ejection more effectively as compared with the case where the AC bias voltage is applied to the guard electrode 20 in accordance with the voltage waveform A1.

Also, in accordance with the voltage waveform B1, immediately before the application of the drive voltage to the ejection electrode 18 is ended, that is, immediately before ejection of the ink is stopped, the bias voltage that is the high voltage is applied to the guard electrode 20. When the bias voltage that is the high voltage is applied to the guard electrode 20 immediately before the ejection of the ink is stopped, the ink at the ejection port 28 becomes hard to eject from the ejection port 28, as described above. The application of the drive voltage to the ejection electrode 18 is ended after the ink is placed under a hard-to-eject state in the manner described above, so unintended ejection of ink droplets is more prevented and a desired amount of an ink droplet is more completely ejected before the completion of an ink ejecting operation than the case where the AC bias voltage is applied to the guard electrode 20 in accordance with the voltage waveform A1.

As can be understood from the above description, when the AC bias voltage is applied to the guard electrode 20 in accordance with the voltage waveform B1, the ink is ejected concurrently with or approximately concurrently with the application of the drive voltage to the ejection electrode 18 and ejection of ink droplets is stopped concurrently with or approximately concurrently with the end of the application of the drive voltage, so it becomes possible to prevent the ink ejection delay more favorably and further improve the ink ejection property.

Next, an operation in the case where the AC bias voltage is applied to the guard electrode 20 in accordance with the voltage waveform C1 show in FIG. 5 will be described.

The voltage waveform C1 in FIG. 5 is an example in which the application time (pulse width) of the high voltage of the AC bias voltage applied to the guard electrode 20 is set shorter than that in the case of the voltage waveform A1. In the voltage waveform C1, like in the case of the voltage waveform B1 described above, the falling of the bias voltage applied to the guard electrode 20 precedes the rising of the drive voltage. On the other hand, the rising of the bias voltage coincides with the falling of the drive voltage. In this example, prior to the application of the drive voltage to the ejection electrode 18, that is, prior to ejection of the ink, the bias voltage applied to the guard electrode 20 is changed from the high voltage to the low voltage, so as described in the explanation of the voltage waveform B1, it becomes possible to prevent ink ejection delay. Also, the bias voltage that is the high voltage is applied concurrently with the end of the application of the drive voltage, so it becomes possible to improve the ink ejection property as compared with conventional cases.

Next, an operation in the case where the AC bias voltage is applied to the guard electrode 20 in accordance with the voltage waveform D1 shown in FIG. 5 will be described.

Figure 7:
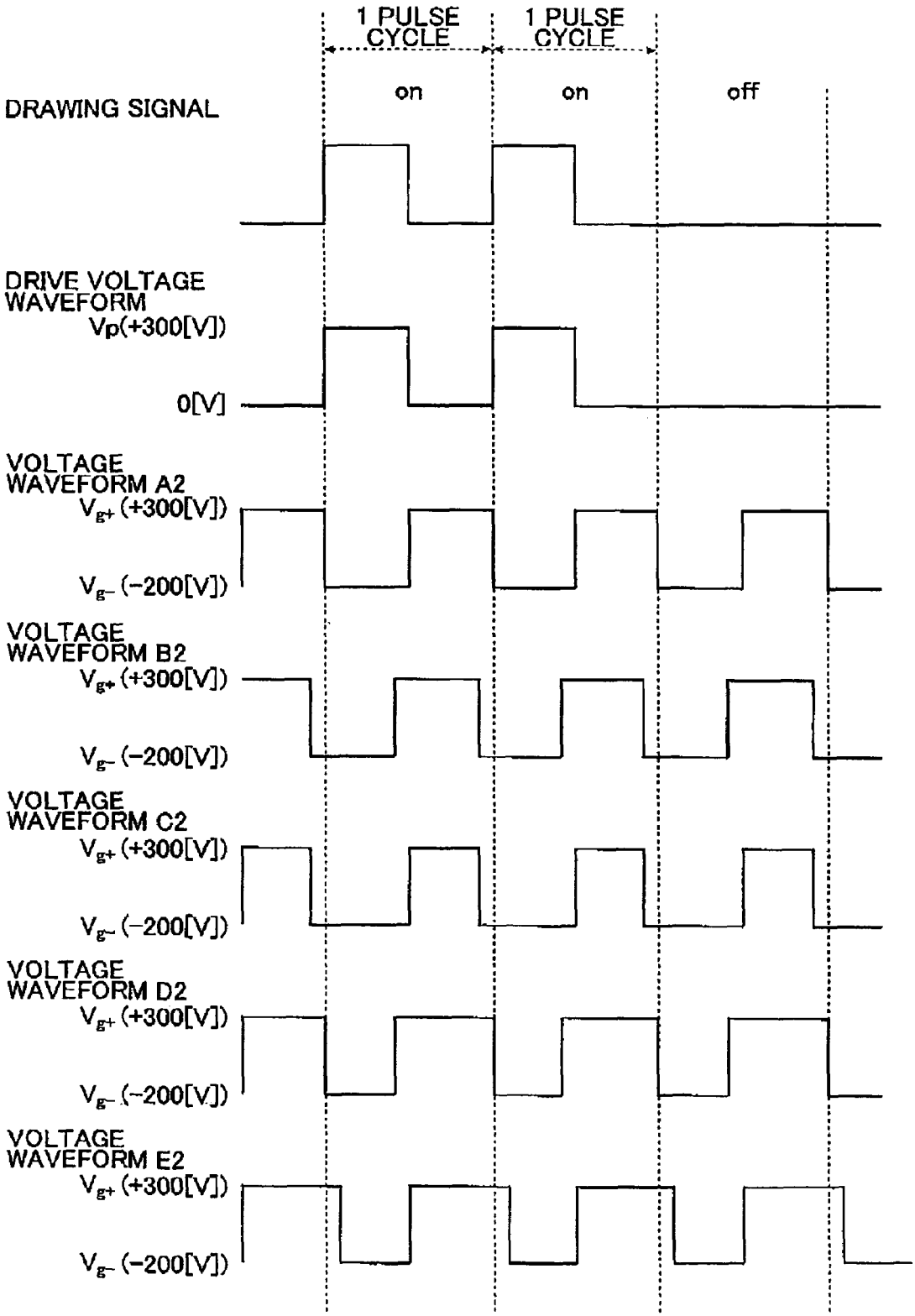
FIG. 7 schematically shows the relations among the drawing signal, the voltage waveform of the drive voltages applied to the ejection electrodes, and the voltage waveforms of the pulse voltage applied to the guard electrode in order to explain a control method that differ from the control method in FIG. 5.

The voltage waveform D1 shown in FIG. 7 is an example in which the application time (pulse width) of the high voltage of the AC bias voltage applied to the guard electrode 20 is set longer than that in the case of the voltage waveform A1. In this voltage waveform, the falling of the AC bias voltage coincides with the rising of the drive voltage applied to the ejection electrode 18. On the other hand, the rising of the AC bias voltage precedes the falling of the drive voltage. In this example, prior to the end of the application of the drive voltage, the bias voltage applied to the guard electrode 20 is changed from the low voltage to the high voltage, so as described in the explanation of the voltage waveform B1, it becomes possible to further improve the ink ejection property. Also, the bias voltage applied to the guard electrode 20 is changed from the high voltage to the low voltage concurrently with the application of the drive voltage to the ejection electrode 18, so it becomes possible to prevent ink ejection delay.

The ink ejection operations of the ink jet head in the case where the AC bias voltage is applied to the guard electrode 20 have been described above. The voltage waveforms A1 to D1 of the AC bias voltage described in the above explanation are each an example and it is possible to generate various other voltage waveforms so long as it is possible to release the meniscus from the pressed state for ink ejection at the time of an ink ejection operation and press the meniscus for prevention of ink ejection at the time of an ink non-ejection operation (non-ejection time). Also, the voltage values of the AC bias voltage are not limited to the voltage values described above and may be set at other arbitrary voltage values unless the ink is ejected merely through the application of the AC bias voltage to the guard voltage 20.

In each of the voltage waveforms shown in FIG. 5, a rectangular wave is used. However, the present invention is not limited to this and a sine wave, a triangular wave, a trapezoidal wave, or the like may be used instead.

In accordance with the voltage waveforms A1 to D1 of the AC bias voltage shown in FIG. 5, regardless of the drawing signal, that is, regardless of whether ink ejection is performed or not, the bias voltage that is the high voltage and the bias voltage that is the low voltage are alternately and repeatedly applied to the guard electrode 20. In other words, even when the ink is not ejected, the bias voltage that is the high voltage and the bias voltage that is the low voltage are applied to the guard electrode 20. As a result, at the time of non-ejection of the ink, the colorant particles and meniscus of the ink at the ejection port are oscillated, which makes it possible to prevent clogging due to overconcentration of the ink.

With the method disclosed in Japanese Patent Application No. 2003-203824, by applying an AC bias voltage to the counter electrode 24 shown in FIG. 1A, the colorant particles and meniscus of the ink at the ejection port 28 are oscillated and clogging is thus prevented. However, the counter electrode 24 is relatively spaced apart from the ejection electrode 18, so there is a danger that when the frequency of the AC bias voltage applied to the counter electrode 24 is increased, in other words, when a drive frequency is increased, an electric field generated between the counter electrode 24 and the ejection electrode 18 will become incapable of following the increased frequency and sufficient oscillation of the colorant particles and meniscus of the ink at the ejection port may become impossible. On the other hand, according to the present invention, the guard electrode 20, to which the AC bias voltage is applied, is set close to the ejection electrode 18, so even when the frequency of the AC bias voltage is increased, it is possible to oscillate the colorant particles and meniscus of the ink at the ejection port 28 with reliability, which makes it possible to prevent clogging more effectively.

Also, it is sufficient that the control portion for driving the guard electrode is provided, so it becomes possible to significantly reduce the overall cost of a drive circuit.

In the above embodiment, the both value of the high voltage and low voltage of the AC bias voltage are positive (plus). However, the present invention is not limited to this, the high voltage value of the AC bias voltage may be set to positive value and the low voltage of the AC bias voltage may be set to negative value.

Hereinafter, an embodiment in which each value of high voltage and low voltage of the AC bias voltage is set to positive value and negative value respectively will be described with reference to FIG. 7.

In FIG. 7, a waveform of a drawing signal (ejection data signal) such as image data or print data, a waveform (pulse waveform) of the drive voltage applied to the ejection electrode, and voltage waveforms A2 to E2 of the pulse voltage applied to the guard electrode are shown. The drawing signal shown on the top level in FIG. 7 is used for designation of ejection and non-ejection of the ink and the ink ejection is controlled based on the drawing signal. As shown in FIG. 7, the cycle and pulse width of the drive voltage (pulse voltage) applied to the ejection electrode are the same as the cycle and pulse width of the drawing signal. Also, the drive voltage Vp applied to the ejection electrode 18 is set at +300 [V], for instance. When the drive voltage is not applied to the ejection electrode 18, the ejection electrode 18 is set at 0 [V], for instance. The voltage value of the drive voltage is not limited to the value described above and may be changed to another arbitrary voltage value so long as it is possible to eject the ink with reliability through application of the drive voltage to the ejection electrode 18.

At the time of a recording operation of the ink jet head shown in FIG. 1A, to the ejection electrode 18, the drive voltage is applied at timings indicated by the drive voltage waveform in FIG. 7. That is, in synchronization with the drawing signal, the drive voltage for ejecting the ink is applied to the ejection electrode 18. When the drawing signal designating ejection of the ink (signal indicated with "on" in FIG. 7) is supplied to the drive voltage control portion 33 connected to the ejection electrode 18, the drive voltage is applied to the ejection electrode 18 at the same timing as the drawing signal. As a result, an electric field causing the ejection of the ink is generated from the ejection electrode 18 and the ink is ejected from the ejection port 28.

On the other hand, when the drawing signal designating non-ejection of the ink (signal indicated with "off" in FIG. 7) is supplied to the drive voltage control portion, no drive voltage is applied to the ejection electrode 18 and the ejection electrode 18 is set at 0 [V] in one pulse cycle. Therefore, no electric field for ejection is generated from the ejection electrode 18 and the ink is not ejected from the ejection port 28. Note that the ink ejection action of the ink jet head 10 will be described in detail later. In FIG. 7, one pulse cycle of the drawing signal corresponds to a time necessary for formation of one dot or one pixel on the recording medium.

In the drive voltage waveform shown in FIG. 7, the pulse width of the drive voltage is set the same as the pulse width of the drawing signal, however, the present invention is not limited to this and the pulse width of the drive voltage may be set longer or shorter than the pulse width of the drawing signal. When the pulse width of the drive voltage applied to the ejection electrode 18, that is, the application time of the drive voltage is adjusted to be longer or shorter in this manner, it becomes possible to adjust the amount of the ink ejected from the ejection port 28, which makes it possible to adjust the gradation of one pixel formed on the recording medium.

Next, the voltage applied to the guard electrode 20 at the time of the recording operation will be described with reference to FIGS. 1A, 6A, 6B and 7. The voltage waveforms A2 to E2 shown in FIG. 7 are each an example of the AC bias voltage (hereinafter referred to as the "pulse voltage") applied to the guard electrode 20. FIG. 6A schematically shows a state of the ejection port 28 in the case where the drive voltage is applied to the ejection electrode 18, and FIG. 6B schematically shows a state of the ejection port 28 in the case where the drive voltage is not applied to the ejection electrode 18 (or in the case where a low voltage is applied thereto).

First, an operation in the case where the pulse voltage is applied to the guard electrode 20 in accordance with the voltage waveform A2 will be described. Note that in the following description, the voltage waveform of the pulse voltage applied to the guard electrode 20 is generated at the guard electrode control portion 35 connected to the guard electrode 20. In accordance with the voltage waveform A2 shown in FIG. 7, a pulse voltage, which has the same frequency as the signal of the drive voltage applied to the ejection electrode 18 and whose phase is delayed by 180° from that of the drive voltage signal, is applied to the guard electrode 20. That is, a pulse voltage signal having a phase opposite to that of the drive voltage signal applied to the ejection electrode 18 is applied to the guard electrode 20. A positive voltage $V_{g+}$ of the pulse voltage is set at +300 [V] and a negative voltage $V_{g-}$ thereof is set at −200 [V], for instance. To the guard electrode 20, the positive voltage $V_{g+}$ and the negative voltage $V_{g-}$ are alternately applied with constant cycles regardless of whether ink ejection is performed or not.

When the pulse voltage applied to the guard electrode 20 is controlled in accordance with the voltage waveform A2 shown in FIG. 7, during the application of the drive voltage to the ejection electrode 18, that is, during the ink ejection (hereinafter referred to as the "ink ejection time") in 1 pulse cycle, the negative voltage $V_{g-}$ of −200 [V] is applied to the guard electrode 20. Under this state, as shown in FIG. 6A, at the ejection port 28, an electric field $E_\alpha$ directed from the ejection electrode 18 to the guard electrode 20 is formed. By means of the electric field $E_\alpha$, as shown in FIG. 6A, an electrostatic force $F_1$ directed toward the surface of the ink (ink ejection direction) is exerted on the colorant particles in the ink at the ejection port 28. As a result, the positively charged colorant particles migrate to the surface of the ink existing at the ejection port 28 and the ink is concentrated at the ejection port 28. Then, the ink at the tip end portion 14*a* of the ink guide 14 is attracted by an attractive force from the counter electrode 24 and a part of the ink is ejected toward the counter electrode 24 as an ink droplet. As a result, a dot of the ink droplet is formed on a surface of the recording medium P disposed on the counter electrode 24. By applying the negative voltage $V_{g-}$ to the guard electrode 20 concurrently with the application of the drive voltage to the ejection electrode 18 in this manner, it becomes possible to cause the colorant particles to aggregate in the ejection port 28 and eject the concentrated ink from the ejection port 28.

On the other hand, as indicated by the voltage waveform A2 in FIG. 7, when the application of the drive voltage to the ejection electrode 18 is ended and the ejection electrode 18 is set at 0 [V] (hereinafter referred to as the "stop time") in 1 pulse cycle, the pulse voltage is changed from the negative voltage $V_{g-}$ (−200 [V]) to the positive voltage $V_{g+}$ (+300 [V]). Under this state, as shown in FIG. 6B, at the ejection port 28, an electric field $E_\beta$ directed from the guard electrode 20 to the ejection electrode 18 is formed. Then, by means of the electric field $E_\beta$, an electrostatic force $F_2$ in a direction opposite to the direction toward the counter electrode 24 is exerted on the colorant particles contained in the ink at the ejection port 28. Therefore, the position of the meniscus M of the ink at the ejection port 28 is forced to an ink flow path 30 side (in the downward direction in FIG. 6B) as compared with the case where the electrostatic force $F_1$ directed toward the counter electrode 24 is exerted, and hence unnecessary spills of the ink are prevented while maintaining the concentratability of the ink at the ejection port 28. By applying the positive voltage $V_{g+}$ having the same polarity as the colorant particles to the guard electrode 20 concurrently with the setting of the drive voltage applied to the ejection electrode 18 at 0 [V] (or a low voltage level) in this manner, the ink formed at the ejection port 28 is made hard to eject and unintended spills of the ink from the ejection port 28 are prevented even when vibration is given to the ink jet head, which makes it possible to enhance the stability of drawing with respect to vibration.

As described above, when the pulse voltage is applied to the guard electrode 20 based on the voltage waveform A2 in FIG. 7, at the time of ejection of the ink, the drive voltage (positive voltage) is applied to the ejection electrode 18 and the negative voltage $V_{g-}$ is applied to the guard electrode 20, which results in a situation in which by means of the electrostatic force based on the electric field directed from the ejection electrode 18 to the guard electrode, the colorant particles migrate to the ink liquid surface at the ejection port 28 and the ink is concentrated. On the other hand, before the ejection of the ink, the positive voltage $V_{g+}$ is applied to the guard electrode 20, so the electrostatic force in the direction opposite to the direction toward the counter electrode 24 is exerted on the meniscus M of the ink at the ejection port 28 and unnecessary spills of the ink are prevented while maintaining the concentratability of the ink at the ejection port 28. By controlling the pulse voltage applied to the guard electrode 20 in this manner, it becomes possible to press the meniscus of the ink by means of the electrostatic force in the direction opposite to the direction toward the counter electrode so that the ink will not spill from the ejection port 28 unless the drive voltage is applied to the ejection electrode 18. Then, concurrently with or approximately concurrently with the application of the drive voltage, the colorant particles aggregate near the ink liquid surface at the ejection port 28 and the meniscus of the ink at the ejection port 28 is released from the pressed state, which makes it possible to eject the concentrated ink from the ejection port 28 swiftly.

Also, when the pulse voltage having the voltage waveform A2 is applied to the guard electrode 20, it becomes possible to control the ejection and non-ejection of the ink with reliability even when the drive voltage applied to the ejection electrode 18 is low. Therefore, even when the drive voltage applied to the ejection electrode is low, a difference in ejection property between when the ejection is ON and when the ejection is OFF is greatly increased as compare with the conventional case. Consequently, it becomes possible to stably eject ink at a low drive voltage and further increase the frequency of the drive voltage.

Further, the pulse voltage is applied to the guard electrode 20 even at the time of non-ejection of the ink, so the colorant particles in the ink at the ejection port 28 are oscillated, which makes it possible to prevent clogging due to over-concentration of the ink.

Next, an operation in the case where the pulse voltage is applied to the guard electrode 20 in accordance with the voltage waveform B2 shown in FIG. 7 will be described. The voltage waveform B2 shown in FIG. 7 is a case where the phase of the pulse voltage differs from that of the drive voltage signal applied to the ejection electrode 18 and is advanced from that in the case of the voltage waveform A2. In the voltage waveform B2, falling of the pulse voltage applied to the guard electrode 20 precedes rising of the drive voltage. Also, rising of the pulse voltage precedes falling of the drive voltage in a like manner.

When the pulse voltage is applied to the guard electrode 20 in accordance with the voltage waveform B2, prior to the application of the drive voltage to the ejection electrode 18, the negative voltage $V_{g-}$ is applied to the guard electrode 20. That is, when the ejection electrode 18 is set at 0 [V], the negative voltage $V_{g-}$ of −200 [V] is applied to the guard electrode. As a result, the electric field directed from the ejection electrode 18 to the guard electrode 20 is formed and the state described above, in which the ink at the ejection port 28 is concentrated, is obtained before ink ejection. That is, during non-ejection of the ink, the colorant particles in the ink are supplied to the ejection port 28. Then, under this state, the drive voltage for ejection of the ink is applied to the ejection electrode 18, so the concentrated ink is ejected from the ejection port 28 concurrently with or approximately concurrently with the application of the drive voltage.

Also, in accordance with the voltage waveform B2, immediately before the application of the drive voltage to the ejection electrode 18 is ended, that is, immediately before the ejection of the ink is stopped, the positive voltage $V_{g+}$ of +300 [V] is applied to the guard electrode 20. Then, after the application of the drive voltage to the ejection electrode 18 is ended, the application of the positive voltage $V_{g+}$ of +300 [V] to the guard electrode 20 is continued and the ejection electrode 18 is set at 0 [V]. Therefore, as described above, the meniscus of the ink at the ejection port 28 is pressed by means of the electrostatic force generated based on the electric field between the guard electrode 20 and the ejection electrode 18. As a result, even when vibration is given to the ink jet head 10, a situation is prevented in which the ink unnecessarily spills from the ejection port.

As can be understood from the above description, when the pulse voltage is applied to the guard electrode 20 in accordance with the voltage waveform B2, the colorant particles aggregate in the ejection port 28 and the ink is concentrated before ejection of the ink, which makes it possible to eject the concentrated ink concurrently with or approximately concurrently with the application of the drive voltage to the ejection electrode 18. Also, after the application of the drive voltage to the ejection electrode 18 is ended, it becomes possible to prevent spills of the ink at the ejection port due to vibration or the like. As a result, it becomes possible to enhance the concentratability and ejection stability of the ink.

Next, an operation in the case where the pulse voltage is applied to the guard electrode 20 in accordance with the voltage waveform C2 shown in FIG. 7 will be described.

The voltage waveform C2 in FIG. 7 is an example in which the application time (pulse width) of the positive voltage $V_{g+}$ of the pulse voltage applied to the guard electrode 20 is set shorter than that in the case of the voltage waveform A2. In the voltage waveform C2, like in the case of the voltage waveform B2 described above, the falling of the voltage applied to the guard electrode 20 precedes the rising of the drive voltage. On the other hand, the rising of the voltage applied to the guard electrode 20 coincides with the falling of the drive voltage. In this example, prior to the application of the drive voltage to the ejection electrode 18, that is, prior to ejection of the ink, the voltage applied to the guard electrode 20 is changed from the positive voltage $V_{g+}$ to the negative voltage $V_{g-}$, so as described in the explanation of the voltage waveform B2, it becomes possible to supply the colorant particles to the ejection port 28 and concentrate the ink at the ejection port 28 before the ejection of the ink. Also, even during the application of the drive voltage to the ejection electrode, the colorant particles are supplied to the ejection port 28 by means of an electrostatic force generated based on an electric field between the ejection electrode 18 and the guard electrode 20, which makes it possible to eject the ink while enhancing the concentratability of the ink. Further, concurrently with the end of the application of the drive voltage, the positive voltage $V_{g+}$ is applied to the guard electrode 20, so a situation is prevented in which unnecessary ink spills from the ejection port after the ink ejection operation.

Next, an operation in the case-where the pulse voltage is applied to the guard electrode 20 in accordance with the voltage waveform D2 shown in FIG. 7 will be described.

The voltage waveform D2 shown in FIG. 7 is an example in which the application time (pulse width) of the positive voltage $V_{g+}$ of the pulse voltage applied to the guard electrode 20 is set longer than that in the case of the voltage waveform A2. In this voltage waveform, the falling of the pulse voltage coincides with the rising of the drive voltage applied to the ejection electrode 18. On the other hand, the rising of the pulse voltage precedes the falling of the drive voltage. In this example, prior to the end of the application of the drive voltage, the voltage applied to the guard electrode 20 is changed from the negative voltage $V_{g-}$ to the positive voltage $V_{g+}$. Also, concurrently with the application of the drive voltage to the ejection electrode 18, the voltage applied to the guard electrode 20 is changed from the positive voltage $V_{g+}$ to the negative voltage $V_{g-}$, so it becomes possible to supply the colorant particles to the ejection port 28 and concentrate the ink at the ejection port 28 before the ejection of the ink and eject the concentrated ink from the ejection port 28 swiftly. Also, even during the application of the drive voltage to the ejection electrode 18, the colorant particles are supplied to the ejection port 28 by means of an electrostatic force generated based on an electric field between the ejection electrode 18 and the guard electrode 20, which makes it possible to eject the ink while enhancing the concentratability of the ink.

Next, an operation in the case where the pulse voltage is applied to the guard electrode 20 in accordance with the voltage waveform E2 shown in FIG. 7 will be described.

The voltage waveform E2 shown in FIG. 7 is an example in which the falling of the pulse voltage applied to the guard electrode 20 is delayed from the rising of the drive voltage and the rising of the pulse voltage is set to coincide with the falling of the drive voltage. Therefore, the pulse width of the voltage waveform E2 becomes the same as that of the voltage waveform D2. In the voltage waveform E2, even immediately after the application of the drive voltage to the ejection electrode 18, the positive voltage $V_{g+}$ is applied to the guard electrode 20. After a predetermined time has passed from the application of the drive voltage to the ejection electrode 18, the voltage applied to the guard electrode 20 is changed from the positive voltage $V_{g+}$ to the negative voltage $V_{g-}$.

When the pulse voltage is applied to the guard electrode 20 based on the voltage waveform E2, prior to the application of the drive voltage, the positive voltage $V_{g+}$ of +300 [V] is applied to the guard electrode. Immediately before the application of the drive voltage to the ejection electrode 18, the ejection electrode 18 is set at 0 [V] (or a low voltage level) and the voltage of +300 [V] is applied to the guard electrode 20. Therefore, under this state, an electric field directed from the guard electrode 20 to the ejection electrode is formed at the ejection port 28, the meniscus of the ink is pressed by an electrostatic force based on the electric field, and unnecessary spills of the ink are prevented.

In addition, when a fixed time passes and the voltage applied to the guard electrode 20 is changed to the negative voltage $V_{g-}$ of −200 [V], as described above, an electric field directed from the ejection electrode 18 to the guard electrode 20 is formed at the ejection port 28. Then, by means of an electrostatic force generated based on the electric field, the colorant particles migrate to the surface of the ink existing at the ejection port 28 and the ink is concentrated at the ejection port 28. Then, the ink at the tip end portion 14*a* of the ink guide 14 is attracted by an attractive force from the counter electrode 24 and a part of the ink is ejected toward the counter electrode 24 as an ink droplet.

Then, concurrently with the end of the application of the drive voltage, the positive voltage $V_{g+}$ is applied to the guard electrode 20 and the meniscus of the ink at the ejection port 28 is pressed by an electrostatic force, as described above. As a result, a situation is prevented in which unnecessary ink spills from the ejection port after the ink ejection operation.

In this example, a case has been described in which the phase of the voltage waveform D2 is delayed such that the rising of the pulse voltage applied to the guard electrode 20 coincides with the falling of the drive voltage. However, the present invention is not limited to this and the falling of the pulse voltage applied to the guard electrode 20 may be delayed from the rising of the drive voltage and the rising of the pulse voltage may be advanced or delayed from the falling of the drive voltage.

The ink ejection operations of the ink jet head in the case where the pulse voltage is applied to the guard electrode 20 have been described above. Regardless of which one of the voltage waveforms A2 to E2 described above is adopted, basically, during a fixed period in which no drive voltage is applied, an electric field is formed between the ejection electrode and the guard electrode by applying the positive voltage $V_{g+}$ to the guard electrode and the ink at the ejection port is concentrated by causing the colorant particles to aggregate in the ejection port by means of an electrostatic force generated from the electric field. At the time of an ink ejection operation, that is, when the drive voltage is applied, the concentrated ink is ejected from the ejection port as an ink droplet.

Also, the voltage waveforms A2 to E2 of the pulse voltage described in the above explanation are each an example and it is possible to generate various other voltage waveforms so long as it is possible to release the meniscus from the pressed state for ink ejection at the time of an ink ejection operation and press the meniscus for prevention of ink ejection at the time of an ink non-ejection operation (non-ejection time). Also, the voltage values of the pulse voltage are not limited to the voltage values described above and may be set at other arbitrary voltage values unless the ink is ejected merely through the application of the pulse voltage to the guard voltage 20. For the sake of prevention of unnecessary ejection due to application of the pulse voltage and prevention of discharge breakdown between the ejection electrode and the guard electrode, it is desirable that the positive voltage value $V_{g+}$ of the pulse voltage applied to the guard electrode 20 be set at 300% or less of the on-time drive voltage applied to the ejection electrode 18 and a potential difference with the off-time voltage applied to the ejection electrode 18 be set at 2000 [V] or less. Also, for the sake of prevention of discharge breakdown between the ejection electrode 18 and the guard electrode, it is preferable that the negative voltage value $V_{g-}$ of the pulse voltage be set such that a potential difference with the on-time voltage applied to the ejection electrode 18 becomes 2000 [V] or less.

Also, when the phase of the signal of the pulse voltage applied to the guard electrode 20 is shifted from that of the signal of the drive voltage applied to the ejection electrode 18, it is preferable that the shift amount of the signal of the pulse voltage applied to the guard electrode 20 be set within a range of +40% to −40% of the duty ratio of the signal of the drive voltage.

In each of the voltage waveforms shown in FIG. 7, a rectangular wave is used. However, the present invention is not limited to this and a sine wave, a triangular wave, a trapezoidal wave, or the like may be used instead.

In accordance with the voltage waveforms A2 to E2 of the pulse voltage shown in FIG. 7, regardless of the drawing signal, that is, regardless of whether ink ejection is performed or not, the positive voltage $V_{g+}$ and the negative voltage $V_{g-}$ are alternately and repeatedly applied to the guard electrode 20. In other words, even when the ink is not ejected, the positive voltage $V_{g+}$ and the negative voltage $V_{g-}$ are applied to the guard electrode 20. As a result, at the time of non-ejection of the ink, the colorant particles and meniscus of the ink at the ejection port are oscillated, which makes it possible to prevent clogging due to overconcentration of the ink.

With the method disclosed in Japanese Patent Application No. 2003-203824, by applying a pulse voltage to the counter electrode 24 shown in FIG. 1A, the colorant particles and meniscus of the ink at the ejection port 28 are oscillated and clogging is thus prevented. However, the counter electrode 24 is relatively spaced apart from the ejection electrode 18, so there is a danger that when the frequency of the pulse voltage applied to the counter electrode 24 is increased, that is, when a drive frequency is increased, an electric field generated between the counter electrode 24 and the ejection electrode 18 will become incapable of following the increased frequency and sufficient oscillation of the colorant particles and meniscus of the ink at the ejection port may become impossible. On the other hand, according to the present invention, the guard electrode 20, to which the pulse voltage is applied, is set close to the ejection electrode 18, so even when the frequency of the pulse voltage is increased, it is possible to oscillate the colorant particles and meniscus of the ink at the ejection port 28 with reliability, which makes it possible to prevent clogging more effectively.

Also, it is sufficient that the guard electrode control portion for driving the guard electrode is provided, so it becomes possible to significantly reduce the overall cost of a drive circuit.

The operation of the ink jet head 10 during the application of a AC bias voltage (a pulse voltage) to the guard electrode 20 of the ink jet head 10 has been described above.

Hereinafter, the present invention will be described in greater detail by reference to the ejection operation for the ink droplets R in the ink jet head 10.

As shown in FIG. 1A, the ink Q containing colorant particles charged in the same polarity as that of the voltage to be applied to the ejection electrode 18 at the time of recording, for example positively charged colorant particles is circulated by an ink circulating mechanism including a pump (not shown) in a direction shown by an arrow (from the left to the right in FIG. 1A) in the ink flow path 30 of the ink jet head 10.

On the other hand, upon recording, the recording medium P on which an image is to be recorded is supplied to the counter electrode 24 and is charged to have the polarity opposite to that of the colorant particles, that is, a negative high voltage (for example, −1500 V) by the charge unit 26. While being charged to the bias voltage, the recording medium P is electrostatically attracted to the counter electrode 24.

In this state, the recording medium P (counter electrode 24) and the ink jet head 10 are moved relatively while the drive voltage control unit 33 performs control so that a pulse voltage (hereinafter referred to as a "drive voltage") is applied to each ejection electrode 18 in accordance with supplied image data. Ejection ON/OFF is basically controlled depending on whether or not the drive voltage is applied, whereby the ink droplets R are modulated in accordance with the image data and ejected to record an image on the recording medium P.

Here, when the drive voltage is not applied to the ejection electrode 18 (or the applied voltage is at a low voltage level), i.e., in a state where the bias voltage is only applied to the counter electrode 24, Coulomb attraction between the bias voltage in the counter electrode 24 and the charges of the colorant particles (charged particles) of the ink Q, Coulomb repulsion among the colorant particles, viscosity, surface tension and dielectric polarization force of the carrier liquid, and the like act on the ink Q, and these factors operate in conjunction with one another to move the colorant particles and the carrier liquid. Thus, the balance is kept in a meniscus shape as conceptually shown in FIG. 1A in which the ink Q slightly rises from the ejection port 28. As described above, in a state in which a drive voltage is not applied to the ejection electrode 18, a positive pulse voltage or a high pulse voltage is basically applied to the guard electrode 20. In other words, an electric field that is directed from the guard electrode 20 toward the ejection electrode 18 is generated. Therefore, an electrostatic force that is directed toward the counter electrode 24 is smaller by the force of the electric field generated from the guard electrode 20 than the case in which no bias voltage is applied to the guard electrode 20. In other words, the ink is prevented from overflowing from the ejection port 28. The Coulomb attraction generated by the electrostatic force directed toward the counter electrode 24 operates in conjunction with other forces to allow the colorant particles to move toward the recording medium P charged by the counter electrode 24 through a so-called electrophoresis process. Therefore, the ink Q is concentrated at the meniscus M formed in the ejection port 28. As described above, the ink Q is prevented from overflowing from the ejection port 28 and is concentrated in the ejection port 28.

From this state, the drive voltage is applied to the ejection electrode 18, during which a negative or a low bias voltage is applied to the guard electrode 20 as described above. As a result, the action from the counter electrode 24 to which the bias voltage is applied, the action from the ejection electrode 18 to which the drive voltage is applied, and the action from the guard electrode 20 to which the pulse voltage or the AC bias voltage is applied are superposed on each other to act on the ink. Then, the motion occurs in which the previous conjunction motion operates in conjunction with the superposition of these actions. The electrostatic force acts on the colorant particles and the carrier liquid by the electric field generated by the application of the drive voltage to the ejection electrode 18 and the application of the pulse voltage or AC bias voltage to the guard electrode 20. Thus, the colorant particles and the carrier liquid are attracted toward the bias voltage side (the counter electrode side), i.e., the recording medium P side by the electrostatic force. The meniscus M formed in the ejection port 28 grows upward to form a nearly conical ink liquid column, i.e., the so-called Taylor cone above the ejection port 28. In addition, similarly to the foregoing, the colorant particles are moved to the meniscus surface through the electrophoresis process and the action of the electric field from the ejection electrode so that the ink Q at the meniscus is concentrated and has a large number of colorant particles at a nearly uniform high concentration.

When a finite period of time further elapses after the start of the application of the drive voltage to the ejection electrode 18, the balance mainly between the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column called the thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P. The growth of the thread and its division, and moreover the movement of the colorant particles to the meniscus and/or the thread are continuously generated while the drive voltage is applied to the ejection electrode. Therefore, the amount of ink droplets ejected per pixel or per dot can be controlled by adjusting the time when the drive voltage is applied.

After the end of the application of the drive voltage (ejection is OFF), the meniscus returns to the above-mentioned state where only the bias voltage is applied to the counter electrode 24 and the guard electrode 20.

In the ink jet head 10 of this embodiment, the ejection electrode 18 is exposed to the ink flow path 30 and is hence in contact with the ink Q as shown in FIG. 1A. Therefore, when the drive voltage is applied to the ejection electrode 18 that is in contact with the ink Q in the ink flow path 30 (ejection is ON), part of electric charges supplied to the ejection electrode 18 is injected into the ink Q, which increases the electric conductivity of the ink Q which is located between the ejection port 28 and the ejection electrode 18. Therefore, in the ink jet head 10 of this embodiment, the ink Q is readily ejected in the form of the ink droplets R (ejection property is enhanced) when the drive voltage is applied to the ejection electrode 18 (when the ejection is ON). Since the ink is ejected in this state based on the principle of ejection as described above, a high quality image can be formed on the recording medium.

In addition, since the ejection port 28 of the ink jet head 10 in this embodiment has a slender-hole shape with respect to the ink flow direction, the ink readily enters the ejection port 28 and the ink supplying property to the ejection port 28 is enhanced. Thus, the ink particles supplying property to the tip end portion 14*a* of the ink guide 14 is also enhanced. Therefore, even if the ink droplets are continuously ejected at a high speed at a higher ejection frequency during image recording, dots of desired size can be consistently formed on the recording medium. Taking the image output time into account, the present invention can achieve an ejection frequency of 5 kHz, preferably 10 kHz and more preferably 15 kHz. In addition, by setting the aspect ratio of the ejection port 28 at 1 or more, the ink flows smoothly and the ejection port 28 can be prevented from being clogged with the ink.

Next, the ink used in the ink jet head 10 of the present invention will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid is low, the concentration of the colorant particles does not occur since the carrier liquid receives the injection of the electric charges and is charged due to a drive voltage applied to the ejection electrodes. In addition, since there is also anxiety that the carrier liquid having a low electrical resistance causes the electrical conduction between the adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar; a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meth) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles are dispersed in the carrier liquid optionally using a dispersing agent, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter (AG-4311 manufactured by ANDO ELECTRIC CO., LTD.) and electrode for liquid (LP-05 manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding the charging control agent thereto.

(2) A method including: adding a colorant and optionally dispersion resin particles and a dispersing agent into a carrier liquid at the same time for dispersion; and adding the charging control agent thereto.

(3) A method including adding a colorant and the charging control agent and optionally the dispersion resin particles and the dispersing agent into a carrier liquid at the same time for dispersion.

Figure 8A:
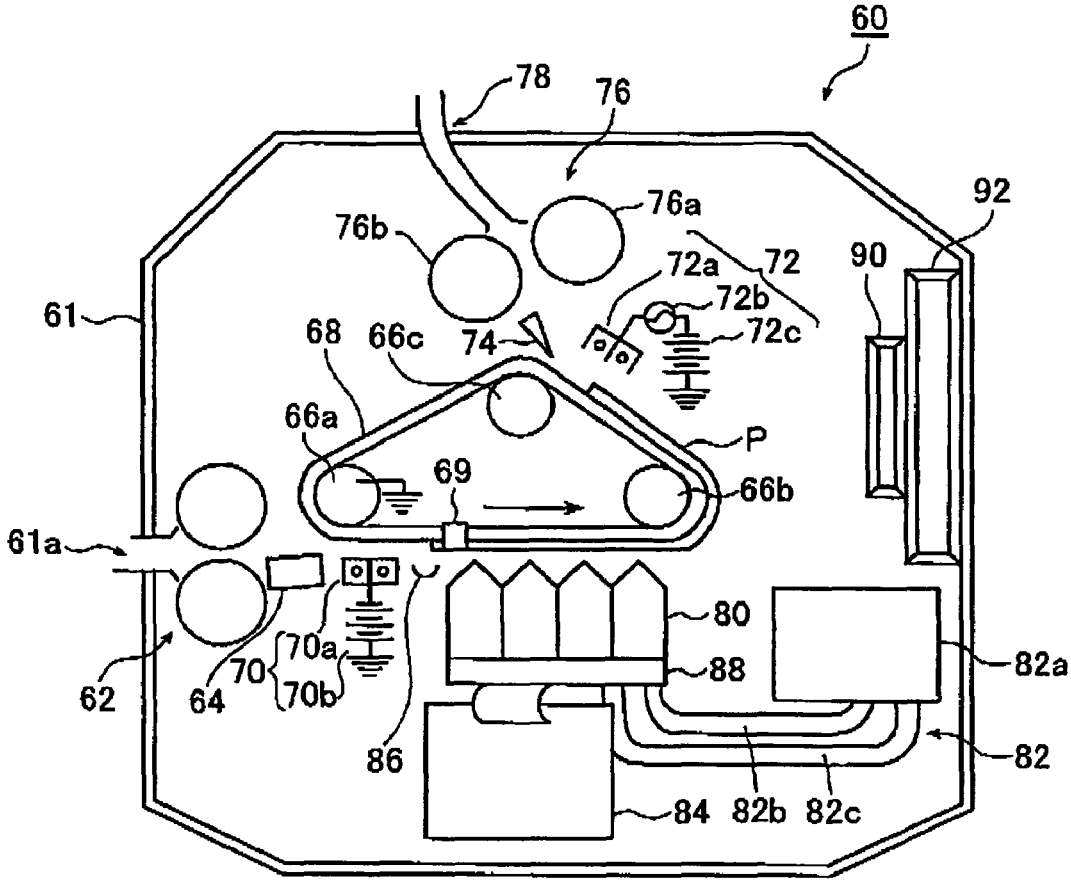
FIG. 8A is a conceptual diagram of an embodiment of the ink jet recording apparatus according to the present invention.

FIG. 8A is a conceptual diagram of an embodiment of an ink jet recording apparatus of the present invention which utilizes the ink jet head implementing the ink jet head control method of the present invention.

An ink jet recording apparatus 60 (hereinafter, referred to as a printer 60) shown in FIG. 8A is an apparatus for performing four-color one-side printing on the recording medium P. The printer 60 includes conveyor means for the recording medium P, image recording means, and solvent collecting means, all of which are accommodated in a casing 61.

The conveyor means includes a feed roller pair 62, a guide 64, rollers 66 (66*a*, 66*b*, and 66*c*), a conveyor belt 68, conveyor belt position detecting means 69, electrostatic attraction means 70, discharge means 72, peeling means 74, fixation/conveyance means 76, and a guide 78. The image recording means includes a head unit 80, an ink circulating system 82, a head driver 84 and recording medium position detecting means 86. The solvent collecting means includes a discharge fan 90, and a solvent collecting device 92.

In the conveyor means for the recording medium P, the feed roller pair 62 is a conveyance roller pair disposed in the vicinity of a feeding port 61*a* provided in a side surface of the casing 61. The feed roller pair 62 feeds the recording medium P fed from a paper cassette (not shown) to the conveyor belt 68 (a portion supported by the roller 66*a* in FIG. 8A). The guide 64 is disposed between the feed roller pair 62 and the roller 66*a* for supporting the conveyor belt 68 and guides the recording medium P fed by the feed roller pair 62 to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt extended over the three rollers 66 (66*a*, 66*b*, and 66*c*). At least one of the rollers 66*a*, 66*b*, and 66*c* is connected to a drive source (not shown) to rotate the conveyor belt 68.

At the time of image recording by the head unit 80, the conveyor belt 68 functions as scanning conveyor means for the recording medium P and also as a platen for holding the recording medium P. After the end of image recording, the conveyor belt 68 further conveys the recording medium P to the fixation/conveyance means 76. Therefore, the conveyor belt 68 is preferably made of a material which is excellent in dimension stability and has durability. The conveyor belt 68 is for example made of a metal, a polyimide resin, a fluororesin, another resin, or a complex thereof.

In the illustrated embodiment, the recording medium P is held on the conveyor belt 68 under electrostatic attraction. In correspondence with this, the conveyor belt 68 has insulating properties on a side on which the recording medium P is held (front face), and conductive properties on the other side on which the belt 68 contacts the rollers 66 (rear face). Further, in the illustrated embodiment, the roller 66*a* is a conductive roller, and the rear face of the conveyor belt 68 is grounded via the roller 66*a*.

In other words, the conveyor belt 68 also functions as the counter electrode 24 including the electrode substrate 24*a* and the insulating sheet 24*b* shown in FIG. 1A when the conveyor belt 68 holds the recording medium P.

A belt having a metal layer and an insulating material layer manufactured by a variety of methods, such as a metal belt coated with any of the above described resin materials, for example, fluororesin on the front face, a belt obtained by bonding a resin sheet to a metal belt with an adhesive or the like, and a belt obtained by vapor-depositing a metal on the rear face of a belt made of the above-mentioned resin may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to shafts of the rollers 66*a* and 66*b* in response to an output of the conveyor belt position detecting means 69, that is, a position of the conveyor belt 68 detected in a width direction, thereby changing a tension at both ends of the conveyor belt in the width direction to suppress the meandering. The rollers 66 may have a taper shape, a crown shape, or another shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveyance direction at the time of image recording. Known detecting means such as a photo sensor may be used.

The electrostatic attraction means 70 charges the recording medium P to a predetermined bias voltage with respect to the head unit 80 (ink jet head of the present invention), and charges the recording medium P to have a predetermined potential such that the recording medium P is attracted to and held on the conveyor belt 68 under an electrostatic force.

In the illustrated embodiment, the electrostatic attraction means 70 includes a scorotron charger 70*a* for charging the recording medium P and a negative high voltage power source 70*b* connected to the scorotron charger 70*a*. While being conveyed by the feed roller pair 62 and the conveyor belt 68, the recording medium P is charged to a negative bias voltage by the scorotron charger 70*a* connected to the negative high voltage power source 70*b* and attracted to the insulating layer of the conveyor belt 68.

Note that the conveying speed of the conveyor belt 68 when charging the recording medium P may be in a range where the charging is performed with stability, so the speed may be the same as, or different from, the conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated embodiment, a corotron charger, a solid-state charger, an electrostatic discharge needle and various means and methods can be employed. As will be described in detail later, at least one of the rollers 66 is composed of a conductive roller, or a conductive platen is disposed on the rear side of the conveyor belt 68 in a recording position for the recording medium P (side opposite to the recording medium P). Then, the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

The head unit 80 uses the ink jet head that implements the ink jet head control method of the present invention to eject ink droplets in accordance with image data to thereby record an image on the recording medium P. As described above, the ink jet head of the present invention uses a charge potential of the recording medium P for the bias voltage and applies a drive voltage to the ejection electrodes 18, whereby the drive voltage is superposed on the bias voltage and the ink droplets R are ejected to record an image on the recording medium P. At this time, the conveyor belt 68 is provided with heating means to increase the temperature of the recording medium P, thus promoting fixation of the ink droplets R on the recording medium P and further suppressing ink bleeding, which leads to improvement in image quality.

Image recording using the head unit 80 and the like will be described in detail below.

The recording medium P on which the image is formed is discharged by the discharge means 72 and peeled off the conveyor belt 68 by the peeling means 74 before being conveyed to the fixation/conveyance means 76.

In the illustrated embodiment, the discharge means 72 is a so-called AC corotron discharger, which includes a corotron discharger 72*a*, an AC power source 72*b*, and a DC high voltage power source 72*c* with one end grounded. In addition thereto, various means and methods, for example, a scorotron discharger, a solid-state charger, and an electrostatic discharge needle can be used for discharge. Also, as in the electrostatic attraction means 70 described above, a structure using a conductive roller or a conductive platen can also be preferably utilized.

A known technique using a peeling blade, a counter-rotating roller, an air knife or the like is applicable to the peeling means 74.

The recording medium P peeled off the conveyor belt 68 is sent to the fixation/conveyance means 76 where the image formed by means of the ink jet recording is fixed. A pair of rollers composed of a heat roller 76*a* and a conveying roller 76*b* is used as the fixation/conveyance means 76 to heat and fix the recorded image while nipping and conveying the recording medium P.

The recording medium P on which the image is fixed is guided by the guide 78 and delivered to a delivered paper tray (not shown).

In addition to the heat roll fixation described above, examples of the heat fixation means include irradiation with infrared rays or using a halogen lamp or a xenon flash lamp, and general heat fixation such as hot air fixation using a heater. Further, in the fixation/conveyance means 76, it is also possible that the heating means is used only for heating, and the conveyance means and the heat fixation means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no components will contact the image recording surface of the recording medium P at least during a time from the image recording with the head unit 80 until the completion of fixation with the fixation/conveyance means 76.

Further, the movement speed of the recording medium P at the time of fixation with the fixation/conveyance means 76 is not particularly limited, which may be the same as, or different from, the conveying speed by the conveyor belt 68 at the time of image formation. When the movement speed is different from the conveying speed at the time of image formation, it is also preferable to provide a speed buffer for the recording medium P immediately before the fixation/conveyance means 76.

Image recording using the printer 60 will be described below in detail.

As described above, the image recording means of the printer 60 includes the head unit 80 for ejecting ink, the ink circulation system 82 that supplies the ink Q to the head unit 80 and recovers the ink Q from the head unit 80, the head driver 84 that drives the head unit 80 based on an output image signal from a not-shown external apparatus such as a computer or a raster image processor (RIP), and the recording medium position detecting means 86 for detecting the recording medium P in order to determine an image recording position on the recording medium P.

Figure 8B:
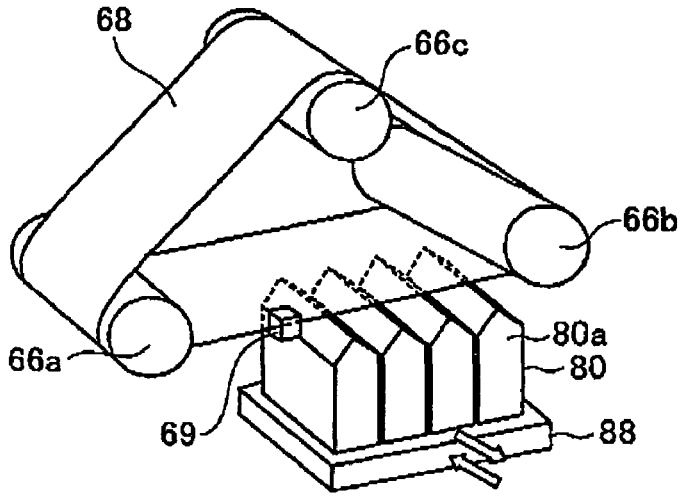
FIG. 8B is a perspective view schematically showing a head unit and a means for transporting a recording medium P on the periphery thereof.

FIG. 8B is a schematic perspective view showing the head unit 80 and the conveyor means for the recording medium P on the periphery thereof.

The head unit 80 includes four ink jet heads 80*a* for four colors of cyan (C), magenta (M), yellow (Y), and black (K) for recording a full-color image, and records an image on the recording medium P transported by the conveyor belt 68 at a predetermined speed by ejecting the ink Q supplied by the ink circulation system 82 as ink droplets R in accordance with signals from the head driver 84 to which image data was supplied. The ink jet heads 80*a* for the respective colors are arranged along a traveling direction of the conveyor belt 68.

Note that the ink jet head 80*a* for each color in the head unit 80 is the ink jet head of the present invention.

In the illustrated embodiment, each of the ink jet heads 80*a* is a line head including ejection ports 28 disposed in the entire area in the width direction of the recording medium P. The ink jet head 80*a* is preferably a multi-channel head as shown in FIG. 2, which has multiple nozzle lines, arranged in a staggered shape.

Therefore, in the illustrated embodiment, while the recording medium P is held on the conveyor belt 68, the recording medium P is conveyed to pass over the head unit 80 once. In other words, scanning and conveyance are performed only once for the head unit 80. Then, an image is formed on the entire surface of the recording medium P. Therefore, image recording (drawing) at a higher speed is possible compared to serial scanning of the ejection head.

Note that the ink jet head of the present invention is also applicable to a so-called serial head (shuttle type head), and therefore the printer 60 may take this configuration.

In this case, the head unit 80 is structured such that a line (which may have a single line or multi channel structure) of the ejection ports 28 for each ink jet head agrees with the conveying direction of the conveyor belt 68, and the head unit 80 is provided with scanning means which scans the head unit 80 in a direction perpendicular to the direction in which the recording medium P is conveyed. Any known scanning means can be used for scanning.

Image recording may be performed as in a usual shuttle type ink jet printer. In accordance with the length of the line of the ejection ports 28, the recording medium P is conveyed intermittently by the conveyor belt 68, and in synchronization with this intermittent conveying, the head unit 80 is scanned when the recording medium is at rest, whereby an image is formed on the entire surface of the recording medium P.

As described above, the image formed by the head unit 80 on the entire surface of the recording medium P is then fixed by the fixation/conveyance means 76 while the recording medium P is nipped and conveyed by the fixation/conveyance means 76.

The head driver 84 receives image data from a system control unit (not shown) that receives image data from an external apparatus and performs various processing on the image data, and drives the head unit 80 based on the image data.

The system control unit color-separates the image data received from the external apparatus such as a computer, an RIP, an image scanner, a magnetic disk apparatus, or an image data transmission apparatus. The system control unit then performs division computation into an appropriate number of pixels and an appropriate number of gradations to generate image data with which the head driver 84 can drive the head unit 80 (ink jet head). Also, the system control unit controls timings of ink ejection by the head unit 80 in accordance with conveyance timings of the recording medium P by the conveyor belt 68. The ejection timings are controlled using an output from the recording medium position detecting means 86 or an output signal from an encoder arranged for the conveyor belt 68 or a drive means of the conveyor belt 68.

The recording medium position detecting means 86 detects the recording medium P being fed to a position at which an ink droplet is ejected onto the medium P from the head unit 80, and known detecting means such as photo sensor can be used.

Here, when the number of the ejection portions to be controlled (the number of channels) is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulating system 82 allows each ink Q to flow in the ink flow path 30 (see FIG. 1A) of the corresponding ink jet head 80*a* of the head unit 80. For each of the ink of the four colors (C, M, Y, K), the ink circulating system 82 includes: an ink circulating device 82*a* having an ink tank, a pump, a replenishment ink tank (not shown), etc.; an ink supply system 82*b* for supplying the ink Q of each color from the ink tank of the ink circulating device 82*a* to the ink flow path 30 of each ink jet head 80*a* of the head unit 80; and an ink recovery system 82*c* for recovering the ink Q from the ink flow path 30 of each ink jet head 80*a* of the head unit 80 into the ink circulating device 82*a*.

An arbitrary system may be used for the ink circulating system 82 as long as this system supplies the ink Q of a color corresponding to each ink jet head 80*a* from the ink tank to the head unit 80 through the ink supply system 82*b* and recovers the ink from each ink jet head 80*a* to the ink tank through the ink recovery system 82*c* to allow ink circulation in a path for returning the ink into the corresponding ink tank.

Each ink tank contains the ink Q of the corresponding color and the ink Q is supplied to the head unit 80 by means of a pump. Ejection of the ink from the head unit 80 lowers the concentration of ink circulating in the ink circulating system 82. Therefore, it is preferable in the ink circulating system 82 that the ink concentration be detected by an ink concentration detecting device and the ink tank be replenished as appropriate with ink from the replenishment ink tank to keep the ink concentration in a predetermined range.

Moreover, the ink tank is preferably provided with an agitator for suppressing precipitation/aggregation of solid components of the ink and an ink temperature control device for suppressing ink temperature change. When the ink temperature changes due to ambient temperature change or the like, physical properties of the ink are changed, which causes the dot diameter change. As a result, a high quality image may not be recorded in a consistent manner.

A rotary blade, an ultrasonic transducer, a circulation pump, or the like may be used for the agitator.

Any known method can be used for ink temperature control, as exemplified by a method in which the ink temperature is controlled with the ink temperature control device which includes a heating element such as a heater or a cooling element such as Peltier element provided in the head unit 80, the ink tank, an ink supply line or the like, and a temperature sensor like a thermostat. When arranged inside the ink tank, the temperature control device is preferably arranged with the agitator such that temperature distribution is kept constant. Then, the agitator for keeping the concentration distribution in the tank constant may double as the agitator for suppressing the precipitation/aggregation of solid components of the ink.

As described above, the printer 60 includes solvent collecting means composed of the discharge fan 90 and the solvent collecting device 92. The solvent collecting means collects the carrier liquid evaporated from the ink droplets ejected on the recording medium P from the head unit 80, in particular, the carrier liquid evaporated from the recording medium P at the time of fixing the image formed of the ink droplets.

The discharge fan 90 sucks air inside the casing 61 of the printer 60 to blow the air to the solvent collecting device 92.

The solvent collecting device 92 is provided with a solvent vapor absorber. This solvent vapor absorber absorbs solvent components of gas containing solvent vapor sucked by the discharge fan 90, and exhausts the gas whose solvent has been absorbed and collected, to the outside of the casing 61 of the printer 60. Various active carbons are preferably used as the solvent vapor absorber.

While the electrostatic ink jet recording apparatus for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulating systems 82 whose number corresponds to the number of ink colors are used.

Furthermore, in the above embodiments, the ink jet recording in which the ink droplets R are ejected by positively charging the colorant particles in the ink and charging the recording medium P or the counter electrode on the rear side of the recording medium P to the negative high voltage has been described. However, the present invention is not limited to this. The ink jet image recording may be performed by negatively charging the colorant particles in the ink and charging the recording medium or the counter electrode to the positive high voltage. When the charged color particles have the polarity opposite to that in the above-mentioned case, the applied voltage to the electrostatic attraction means, the counter electrode, the drive electrode of the ink jet head, or the like is changed to have the polarity opposite to that in the above-mentioned case.

While the ink jet head, ink jet head control method and ink jet recording apparatus according to the present invention have been described above in detail, it should be noted that the invention is by no means limited to the foregoing embodiments and various improvements and modifications may of course be made without departing from the scope and spirit of the invention.

What is claimed is:

1. A control method for controlling an ink jet head that ejects droplets of ink by means of electrostatic forces, said ink jet head including an ejection port substrate having ejection ports for ejection of said droplets, ejection electrodes respectively being located in a position corresponding to each of said ejection ports and respectively generating electrostatic fields for each of said ejection ports, and a guard electrode formed in said ejection port substrate under an insulated state from the ejection electrodes at positions on an ink ejection side with respect to said ejection electrodes between adjacent ejection ports in order to shield against electric fields generated from adjacent ejection electrodes and commonly controlled, said control method comprising the steps of:

applying a drive voltage to each of said ejection electrodes in accordance with a drawing signal; and applying an AC bias voltage to said guard electrode, said AC bias voltage having the same frequency as said drive voltage applied to each of said ejection electrodes and alternately repeating a first voltage and a second voltage being lower than said first voltage.

2. The control method according to claim 1, wherein said first voltage is a positive voltage and said second voltage is a negative voltage.

3. The control method according to claim 1, wherein said AC bias voltage is applied such that a phase thereof is opposite to a phase of a signal of said drive voltage at the time of formation of one dot on a recording medium.

4. The control method according to claim 1, wherein said AC bias voltage is applied such that at least one of phase and pulse width thereof differs from those of a signal of said drive voltage at the time of the formation of one dot on a recording medium.

5. The control method according to claim 4, wherein at least one of a phase and pulse width of said AC bias voltage is controlled such that said AC bias voltage changes to said second voltage immediately before said drive voltage is applied to each of said ejection electrodes.

6. The control method according to claim 4, wherein at least one of a phase and a pulse width of said AC bias voltage is controlled such that said AC bias voltage changes to said first voltage before the completion of application of said drive voltage to each of said ejection electrodes.

7. The control method according to claim 1, wherein said ink is obtained by dispersing charged fine particles containing at least colorant in an insulative dispersion medium.

8. An ink jet head for recording an image on a recording medium by ejecting droplets of ink including charged fine particles by means of electrostatic forces, said ink jet head comprising:

an ejection port substrate having ejection ports for ejection of said droplets;

ejection electrodes respectively being located in a position corresponding to each of said ejection ports and respectively generating electrostatic fields for each of said ejection ports;

a guard electrode formed in the ejection port substrate under an insulated state from the ejection electrodes at positions on an ink ejection side with respect to the ejection electrodes between adjacent ejection ports in order to shield against electric fields generated from adjacent ejection electrodes; and a guard electrode control portion connected to said guard electrode for controlling an AC bias voltage to apply said AC bias voltage to said guard electrode, said AC bias voltage having the same frequency as said drive voltage applied to each of said ejection electrodes and alternately repeating a first voltage and a second voltage being lower than said first voltage.

9. The ink jet head according to claim 8, wherein said first voltage is a positive voltage and said second voltage is a negative voltage.

10. The ink jet head according to claim 8, wherein said AC bias voltage is applied such that its phase is opposite to that of a signal of the drive voltage at the time of formation of one dot on a recording medium.

11. The ink jet head according to claim 8, wherein said AC bias voltage is applied such that at least one of phase and pulse width thereof differs from those of the signal of the drive voltage at the time of the formation of one dot on the recording medium.

12. The ink jet head according to claim 11, wherein at least one of a phase and pulse width of said AC bias voltage is controlled such that said AC bias voltage changes to said second voltage immediately before said drive voltage is applied to each of said ejection electrodes.

13. The ink jet head according to claim 11, wherein at least one of a phase and a pulse width of said AC bias voltage is controlled such that said AC bias voltage changes to said first voltage before the completion of application of said drive voltage to each of said ejection electrodes.

14. The ink jet head according to claim 8, wherein said ink is obtained by dispersing charged fine particles containing at least colorant in an insulative dispersion medium.

15. An ink jet recording apparatus, comprising:

an ink jet head for recording an image on a recording medium by ejecting droplets of ink including charged fine particles by means of electrostatic forces; and moving means for relatively moving said ink jet head and said recording medium, wherein said ink jet head includes an ejection port substrate having ejection ports for ejection of said droplets;

ejection electrodes respectively being located in a position corresponding to each of said ejection ports and respectively generating electrostatic fields for each of said ejection ports;

a guard electrode formed in the ejection port substrate under an insulated state from the ejection electrodes at positions on an ink ejection side with respect to the ejection electrodes between adjacent ejection ports in order to shield against electric fields generated from adjacent ejection electrodes; and a guard electrode control portion connected to said guard electrode for controlling an AC bias voltage to apply said AC bias voltage to said guard electrode, said AC bias voltage having the same frequency as said drive voltage applied to each of said ejection electrodes and alternately repeating a first voltage and a second voltage being lower than said first voltage.

16. The ink jet recording apparatus according to claim 15, wherein said first voltage is a positive voltage and said second voltage is a negative voltage.

* * * * *